US008832972B2

(12) United States Patent
Kemp

(10) Patent No.: US 8,832,972 B2
(45) **Date of Patent: *Sep. 16, 2014**

(54) COLLAPSIBLE SHOE AND REPLACEABLE STRAPS AND METHODS FOR MAKING AND USING SAME

(76) Inventor: Quintana Kemp, San Diego, CA (US)

( * ) Notice: Subject to any disclaimer, the term of this patent is extended or adjusted under 35 U.S.C. 154(b) by 604 days.

This patent is subject to a terminal disclaimer.

(21) Appl. No.: 13/151,576

(22) Filed: Jun. 2, 2011

(65) Prior Publication Data

US 2012/0137543 A1 Jun. 7, 2012

Related U.S. Application Data

(63) Continuation-in-part of application No. 12/107,760, filed on Apr. 22, 2008, now Pat. No. 7,975,405, which is a continuation-in-part of application No. 11/530,377, filed on Sep. 8, 2006, now Pat. No. 7,578,075.

(60) Provisional application No. 60/715,745, filed on Sep. 10, 2005.

(51) Int. Cl.

| | |
|---|---|
| ***A43B 21/36*** | (2006.01) |
| ***A43B 3/24*** | (2006.01) |
| ***A43B 21/48*** | (2006.01) |
| ***A43B 21/39*** | (2006.01) |
| ***A43B 21/38*** | (2006.01) |

(52) U.S. Cl.

CPC . *A43B 3/24* (2013.01); *A43B 21/48* (2013.01); *A43B 21/39* (2013.01); *A43B 21/38* (2013.01)

USPC ..... 36/100; 36/36 R; 36/42

(58) Field of Classification Search

USPC ..... 36/15, 100, 101, 42, 36 R, 36 B, 36 C

See application file for complete search history.

(56) References Cited

U.S. PATENT DOCUMENTS

| | | | | | |
|---|---|---|---|---|---|
| 1,142,662 | A | * | 6/1915 | Blaney | 36/36 R |
| 1,156,769 | A | * | 10/1915 | Fortin | 36/36 R |
| 1,633,449 | A | * | 6/1927 | Mayorowitz | 36/36 C |
| 2,852,864 | A | * | 9/1958 | Quirk | 36/34 A |
| 3,007,261 | A | * | 11/1961 | Soler | 36/42 |
| 4,887,369 | A | | 12/1989 | Bailey et al. | |
| 5,058,290 | A | * | 10/1991 | Koehl et al. | 36/42 |
| 5,953,836 | A | * | 9/1999 | Watt et al. | 36/42 |

(Continued)

FOREIGN PATENT DOCUMENTS

WO WO 96-10346 A1 4/1996

*Primary Examiner* — Marie Bays

(74) *Attorney, Agent, or Firm* — TDFoster; Thomas D. Foster; Bruce Hare

(57) ABSTRACT

A shoe is described having a removable heel, removable platform, and in some embodiments one or more removable straps. The shoes of the present invention provide for flexibility in design with the same sole by allowing for replacement of one type of heel with another and in some shoes replacement of the strap or straps by alternate styles or colors of straps. The replaceability or modularity of the heel and straps allows for compact storage as well, which is desirable during travel. The removeability of the platform enables the shoe to adjust to different heights. Additionally, some embodiments have one or more hinges formed in the sole to allow the shoe to collapse to an even smaller size for storage or travel.

12 Claims, 33 Drawing Sheets

(56) References Cited

U.S. PATENT DOCUMENTS

| | | | | |
|---|---|---|---|---|
| 6,430,846 | B1 * | 8/2002 | Lin | 36/101 |
| 6,467,198 | B1 | 10/2002 | James | |
| 7,168,184 | B2 * | 1/2007 | Wallin et al. | 36/15 |
| 7,578,075 | B1 * | 8/2009 | Kemp | 36/100 |
| 8,104,198 | B2 | 1/2012 | Barras | |
| 2001/0052195 | A1 * | 12/2001 | Blakey | 36/100 |
| 2005/0016019 | A1 * | 1/2005 | Smith et al. | 36/11.5 |
| 2007/0256330 | A1 * | 11/2007 | Wallin et al. | 36/102 |

* cited by examiner

COLLAPSIBLE SHOE AND REPLACEABLE STRAPS AND METHODS FOR MAKING AND USING SAME

RELATED APPLICATIONS

This application is continuation-in-part application, which claims priority to U.S. Utility patent application Ser. No. 12/107,760, filed on Apr. 22, 2008, which claims priority to U.S. Utility patent application Ser. No. 11/530,377, filed on Sep. 8, 2006, now issued U.S. Pat. No. 7,578,075, which claims priority to U.S. Provisional Patent Application Ser. No. 60/715,745 filed on Sep. 10, 2005, which are all hereby incorporated by reference for all that they disclosed.

FIELD OF THE INVENTION

The present invention relates in general to shoes and methods for using and making same and more particularly to a collapsible shoe and a shoe having interchangeable straps and methods for using and making same.

DESCRIPTION OF THE PRIOR ART

Shoes have been in existence for thousands of years. Their utility is beyond question. There are numerous varieties of shoes. Various types and styles of shoes may be used for different occasions such as formal occasions or informal occasions.

When traveling, multiple pairs of shoes are often needed in order that an appropriate pair of shoes is available to a traveler for any particular social occasion and to match various articles of clothing brought by the traveler. Packing multiple pairs of shoes in one's luggage can often take an excessive amount of space and may not be practical.

Furthermore, shoes are often singular in styling and aesthetics and can be limited in their ability to match various types of attire or styling.

BRIEF SUMMARY OF THE INVENTION

In one embodiment, a collapsible shoe is disclosed comprising a sole, a heel, and a connector, wherein the connector is configured to removably attach the heel to the sole.

In some embodiments, the connector is a threaded rod. In some embodiments, the connector is a threaded rod extending through the heel and further comprises a threaded cap nut. The threaded cap nut in some embodiments is part of the sole of the shoe and in other embodiments it is separate from the sole and attaches the sole to the heel.

In another embodiment, a collapsible shoe is disclosed having a base that includes a heel portion where the heel portion includes a base cavity, a heel insert configured to be accepted by the base cavity, a vertical lock disposed at the heel portion of the base where the vertical lock engages the heel insert within the base cavity to secure the removable heel to the base, and a horizontal lock disposed at the heel portion of the base adjacent to the vertical lock where the horizontal lock engages the vertical lock in order to secure the vertical lock and to prevent the vertical lock from disengaging from the heel insert.

In another embodiment, a collapsible shoe is disclosed comprising a first sole portion, a second portion and a hinge wherein the hinge connects the first sole portion to the second portion.

In another embodiment, a collapsible shoe is disclosed comprising a removable strap portion. Some such embodiments further comprise a removable heel portion.

In some of the embodiments, the removable heel portion further comprises slots adapted to connect removable heel portion to the sole portion.

In another aspect, a modular decorative element is disclosed comprising a first decorative portion and a second base portion, wherein the decorative portion removably attaches to the base portion. In some such embodiments, the decorative portion further comprises a jewel, ornamentation or any other aesthetic item. Some embodiments of the modular decorative element further comprise a connection. In some such embodiments, the connection further comprises slots or channels. Other embodiments comprise at least one connection, which further comprises at least one magnet.

In some embodiments, the base portion further comprises an earring, a pendant, a broach, a ring, a shoe portion, or further connective portion adapted to connect the decorative element to other clothing, body part or device.

The present application also includes elaboration of the interchangeable strap mechanism, which may include a quick release mechanism used in attaching and detaching the upper straps to the base of the shoe. The same quick lease mechanism for the straps can be used on any range of base heights.

In one embodiment, a shoe base is disclosed comprising of a removable strap portion with a quick release locking mechanism. FIG. 27, shows a side profile drawing of a flat shoe base 1801, with a removable strap 2626 attached. The quick release button 2207 is shown at rest, the strap material can be sewn to the roll bar 2415 of the quick release strap mechanism, and the mechanism can be securely fastened to the base. When the strap is attached to the shoe it secures the foot to the base enabling a person to walk in the shoe. FIG. 27, illustrates that when the button is at rest, it can be flush with the back of the shoe base. To release the strap attachment device, the button is pressed into the shoe base, thus unhooking the quick release strap mechanism and allowing the strap material to be removed from the base.

In another embodiment, the strap locking mechanism can be activated using a lever instead of a button that can be moved from one side of the base to another, thus allowing the quick release mechanism to be disengaged and the strap to be released.

In another embodiment, the button could be replaced with multiple buttons or pins that are pressed into the shoe base and release the strap mechanism.

In another embodiment, the button or like mechanism, could be situated in another location on the shoe base, the location is not limited to the back of the shoe base. The button can be located under the arch of the shoe base or on the side of the base. The button or pin can range in size depending on the design appeal for the shoe style.

BRIEF DESCRIPTION OF THE DRAWINGS

The features disclosed herein and the manner of attaining them will become apparent and will be best understood by reference to the following description of certain embodiments taken in conjunction with the accompanying drawings, wherein:

FIG. 6 is a side elevational view of the collapsible shoe embodiment of

DETAILED DESCRIPTION OF CERTAIN EMBODIMENTS

Figure 1:
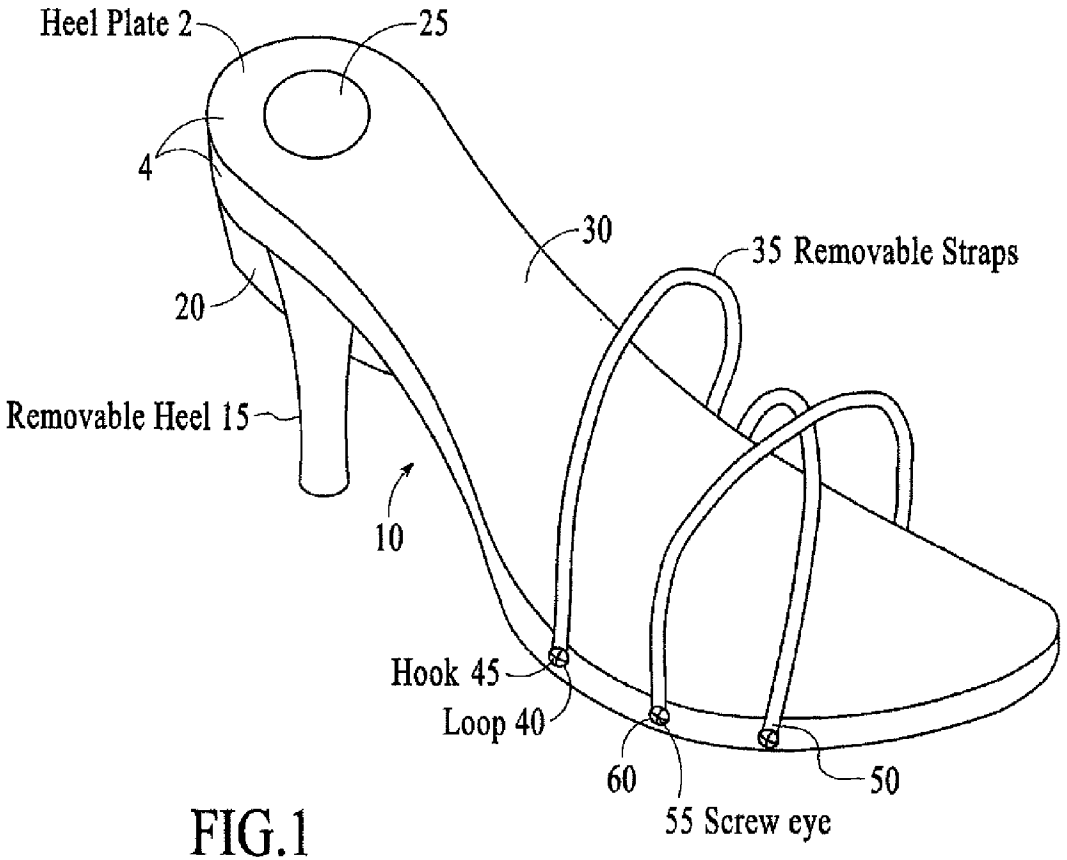
FIG. 1 is a perspective view of one embodiment of a collapsible shoe.

It will be readily understood that the components of the embodiments as generally described and illustrated in the drawings herein, could be arranged and designed in a wide variety of different configurations. Thus, the following more detailed description of the embodiments of the system, components and methods of the present embodiments, as represented in the drawings, is not intended to limit the scope of any invention, but is merely representative of the various embodiments.

I. A Collapsible Shoe Having a Removable Heel

According to certain embodiments, there is provided a collapsible shoe having a removable heel. The removable heel being removably attached to the base, or sole of the shoe. In some embodiments, the removable attachment is via a threaded rod or the like, and a fastening device such as a cap nut while in other embodiments it is via slots or dovetails or other locking mechanism. The shoe may further include one or more removable straps releasably attached to the base of the shoe. The releasable attachment can be via hooks and loops, via tabs and slots, via balls, via latch and slots or any other engaging/disengaging mechanism.

In some embodiments, the connector is part of the heel. The connector is a modification to the heel head designed so to fit securely into the sole. The sole has a release button that is depressed so the heel head may slide past it and fit into an empty cavity. The heel enters the cavity and locks into place by wedging against the button head and the back of the sole.

According to other embodiments, there is provided a method of manufacturing a collapsible shoe having a removable heel including the steps of forming a base having a fastening device such as a cap nut formed therein or an empty cavity with a release mechanism such as a button. The method further includes providing a removable heel and sole with a release button or the like for releasably attaching the removable heel to the base. The method of some embodiments further includes providing removable straps for removable attachment to the base.

According to yet another embodiment, there is provided a method of using a collapsible shoe having a removable heel including the steps of attaching a removable heel to the base of a collapsible shoe to prepare the collapsible shoe for subsequent use, and subsequently removing the removable heel to collapse the collapsible shoe for storage. The method of use may further include attaching one or more straps to the base.

According to yet another embodiment, a decorative element is disclosed that can be part of the collapsible shoe in order to provide modular decorative elements to the shoe. The decorative element provides easy quick fastening of jewels or other aesthetic elements to clothes, jewelry, shoes or other items.

Referring now to the drawings and more particularly to FIG. 1 thereof, there is shown a collapsible shoe 10 having a removable heel 15. The removable heel 15 of the illustrated embodiment is attached to the collapsible shoe 10 near its rear end in a manner in which it may be removed and replaced. Some embodiments of the collapsible shoe include a base 30 for supporting the wearer's foot (not shown). The base 30 in some embodiments is formed of a suitable material, such as plastic, cardstock material, wood or other suitable material or combination thereof. The bottom surface of the base 30 of some embodiments forms the sole (not shown) of the collapsible shoe 10. The sole is formed of any material, such as rubber, cork, leather, wood or other suitable material or combination thereof.

Some embodiments of the collapsible shoe 10 further include a heel plate 20 interposed between the base 30 and the removable heel 15. The heel plate 20 may serve to support the removable heel 15 and to rigidly and releasably mount the removable heel 15 to the base 30. In some embodiments, the heel plate 20 is formed of a rigid material such as plastic, wood or metal and may either be permanently or releasably attached to the base 30.

Some embodiments of the collapsible shoe 10 further include an empty cavity 173 for the heel head 167 to slide past a button 163 and lock into place. The empty cavity is molded into the base predesigned to fit the head of the heel.

A fastening device such as a cap nut 25 is counter sunk within the base 30 of some embodiments and is permanently affixed thereto in some such embodiments. The cap nut 25 is used to mate with a threaded rod 70 (FIG. 2) which is inserted through a central axial bore 80 in the removable heel 15 and the heel plate 20 and which, in some embodiments, removably affixes the removable heel 15 and heel plate 20 to the base 30.

With continued reference to FIG. 1, some embodiments include one or more removable straps 35 that are releasably attached to the base 30 of the collapsible shoe 10 in order to provide support and to contain the user's foot (not shown) onto the base 30 of the collapsible shoe 10. The removable straps 35 of some embodiments also serve to add decorative content to the collapsible shoe 10. For example, the removable straps 35 may be formed of different colors or materials to match the outfit of the user (not shown). In some embodiments, different thicknesses of the straps may be employed to achieve a variety of styles and appearances.

Referring again to FIG. 1, the removable straps 35 of some embodiments are releasably attached to the base 30 of the collapsible shoe 10 via a set of loops and hooks, such as loop 40 and hook 45. In such embodiments, in order to releasably attach the removable straps 35 to the base 30, one or more loops in the form of screw eyes, such as loop 40, are attached to the outside edge of the base 30. In one embodiment, three loops 40, 50 and 60 are attached to the outside base 30. The releasable straps shown generally at 35 each contain a hook, such as hooks 45, 55, and 65, which are adapted to releasably attach to their corresponding loops 40, 50, and 60, respectively. In this regard, the releasable straps may be releasably attached to the base 30. It should be understood that any number of loops can be attached to the outside edge of the base in multiple positions to receive any number of releasable straps. Furthermore, the hooks and loops may be replaced with Velcro® or any other attachment devices. It is contemplated that the straps may be attached to the base 30 in a variety of different configurations to achieve a variety of different appearances for the shoe 10.

Figure 14:
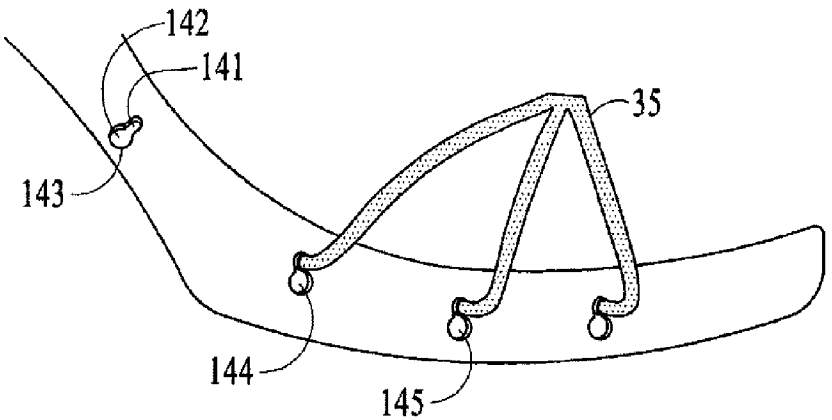
FIG. 14 is a side view of FIG. 7 illustrating the use of FIG. 13 as it pertains to removing a strap.

In some embodiments, a retainer clasp 152 is used to attach and detach a strap from the base of the shoe. In this method a series of strap retainers 140 are molded into the base. In some embodiments, one end of the clasp attaches to the fabric via a jump ring or like material and the other end of the clasp fits into the lower strap retainer 143, moves up thru the retainer 142 and into the third chamber of the retainer 141 to lock into place. The three retainers are slightly different sizes. In some embodiments, the lower retainer 143 is slightly larger than the other two, thus creating tension on the clasp 152 as it moves into the third retainer 141. In some embodiments, this tension is what keeps the clasp in place, thus securing the strap to the base of the shoe. In FIG. 14, 144 shows the clasp in the locked position in strap retainer 141. When the clasp is in the unlocked position, it is in the lower strap retainer 143 and is demonstrated in 145. The size, shape, material make-up, and texture of the clasp will vary depending upon style and designer. The clasp and strap retainer mechanism is not limited to any hole size or shape as well. It should be understood that there can be any number of strap retainers on the sides of the sole and retainers may also be located under the sole or on the top surface. The strap retainers may appear in different shapes such as squares, ovals, rectangles.

In some embodiments the clasp will enter one hole and lock into place via the tension caused by material or size of the retainer. When the clasp moves past the small retainers (regardless of size and shape) into the shoe it will lock into place due to the side tension placed on the clasp. It doesn't have to move into a second chamber or third chamber to lock.

In operation, the user of the collapsible shoe 10 may first assemble the collapsible shoe 10 by attaching the removable heel 15 to the heel plate 20 which is removably attached to the base 30 as illustrated in the embodiment illustrated in FIG. 1 or in any of the embodiments illustrated and/or described in Exhibit B. In addition, the removable straps 35 or any embodiment illustrated in Exhibit B may be releasably attached to the outer edge of the base 30 by inserting the hooks of each releasable strap onto the loops attached to the outer edge of the base 30 or as illustrated in Exhibit B. For example, hook 45 would be releasably attached to the loop 40. After the collapsible shoe 10 is assembled as described heretofore, the user may place their foot (not shown) onto the base 30. The foot (not shown) of the user (not shown) may then be held by the releasable straps 35 and may thereby walk with the collapsible shoe 10.

Figure 10:
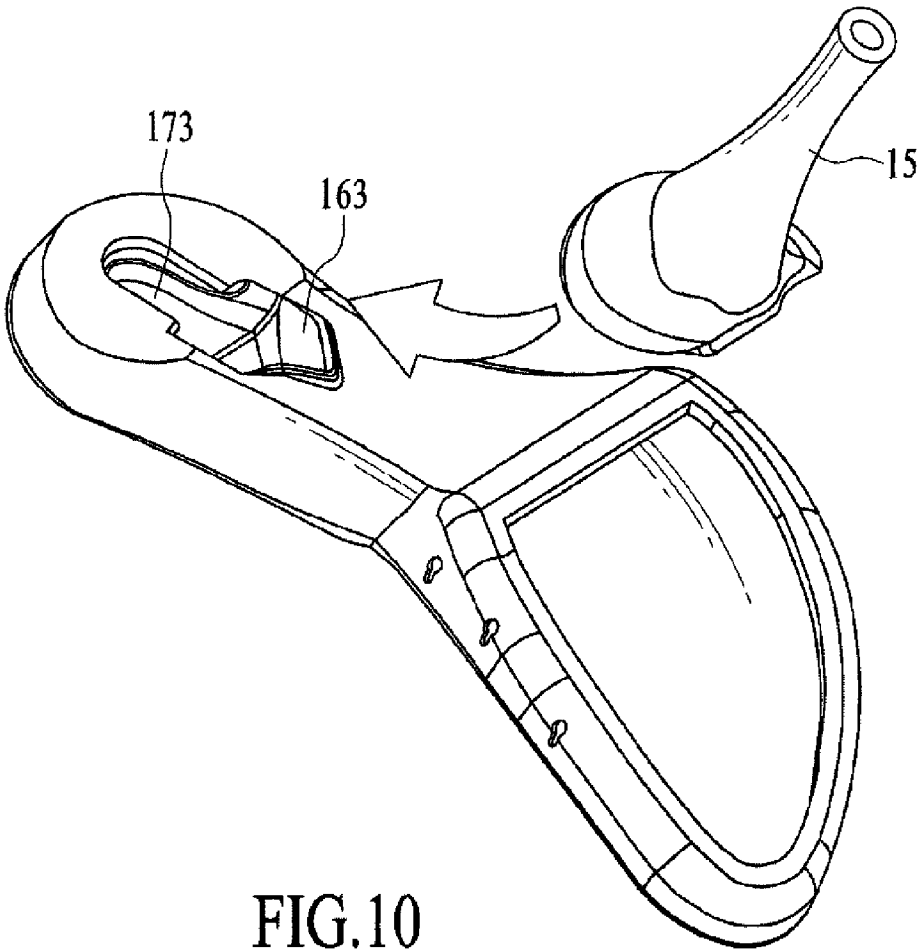
FIG. 10 is an exploded view of a heel sliding into the base

In another embodiment, FIG. 10 illustrates the removable heel 15 sliding into the base from the toe of the heel to back of the shoe. The heel slides over 163 the spring loaded release button. As it slides past the button, the weight of the heel with the pressure of the user depresses the heel and creates a space for the heel to move into the empty cavity. The head of the heel 167 slides along the bottom of the heel cavity and the heel attachment site 170 becomes flush with the base of the shoe. As the heel moves completely into the cavity, the button no longer is blocked and the spring lifts forward to become flush with the heel front 171.

Figure 8:
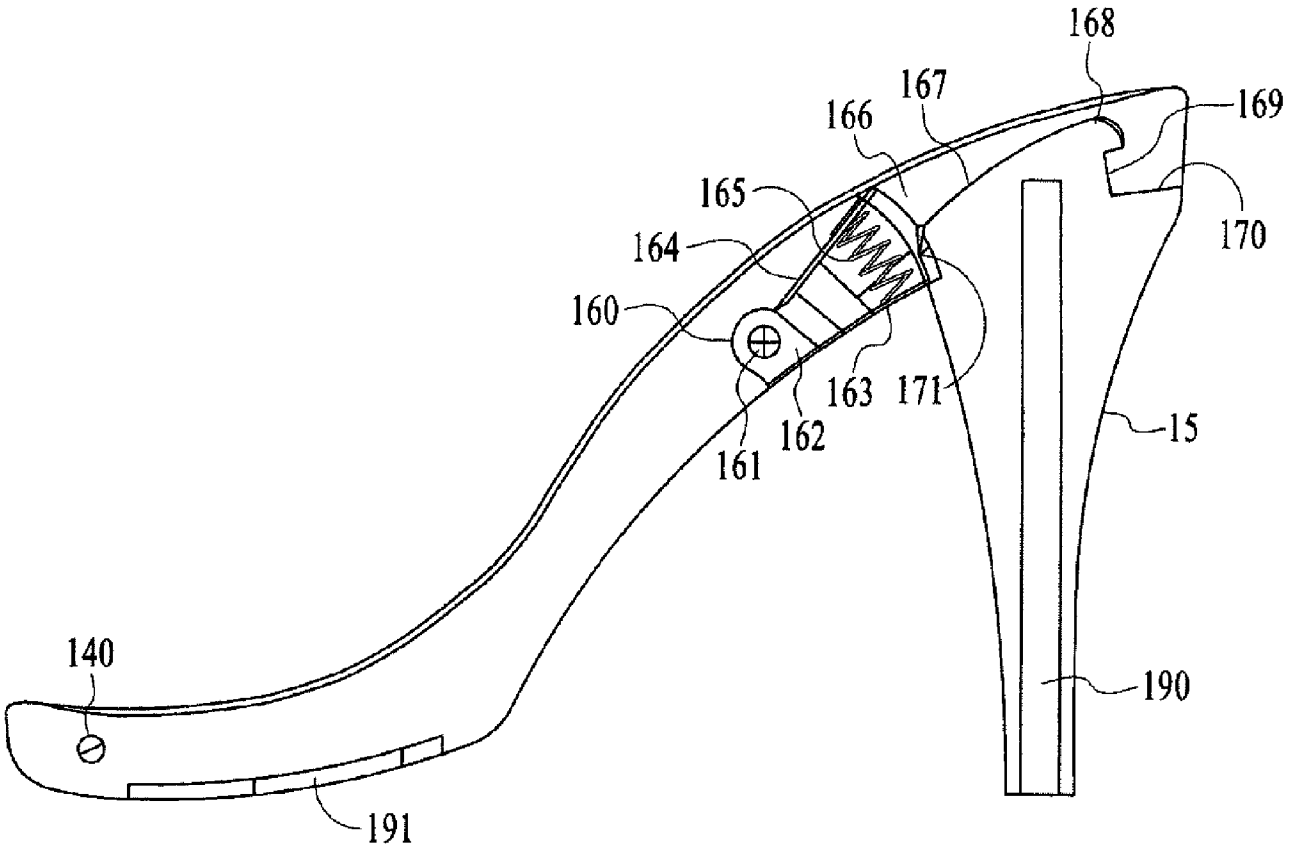
FIG. 8 is a cross-sectional side view of the base and removable heel.

In some embodiments, the removable heel 15 is locked into place, see FIG. 8, and held there by 171 the front of the heel head resting flush with 166 the back of the spring loaded retaining button. The two surfaces, rest against each other when the heel is in a locked position. Once the heel is into the hollow cavity, the button is released and keeps the heel in place. In some embodiments, when 163 is pushed down, the spring recoils and allows 171 to slide out and past 163 the spring loaded retainer button, thus releasing the heel from the sole.

In a similar manner, when the user of the collapsible shoe 10 desires to collapse the collapsible shoe 10 for storage or for travel, the user (not shown) would remove their foot (not shown) from the base 30. The removable heel 15 would then be removed thereby reducing the required space for storing of for traveling. The heel plate 20, on embodiments having a separate such part, may also be removed from the base 30 to further collapse and reduce the required space for the collapsible shoe 10.

Figure 3:
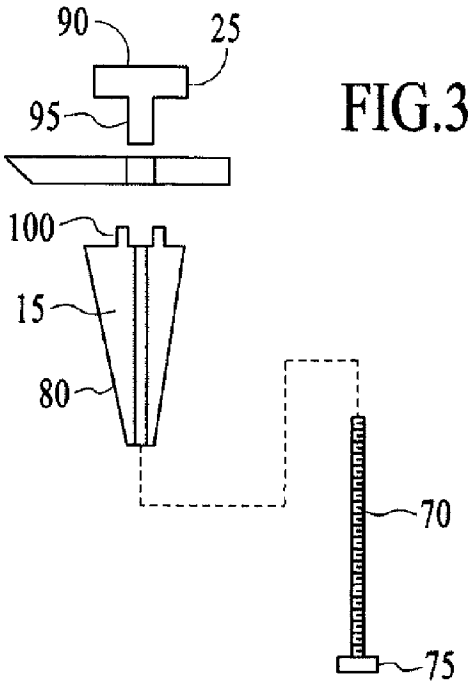
FIG. 3 is an exploded view of a portion of the embodiment illustrated in FIG. 3.
Figure 2:
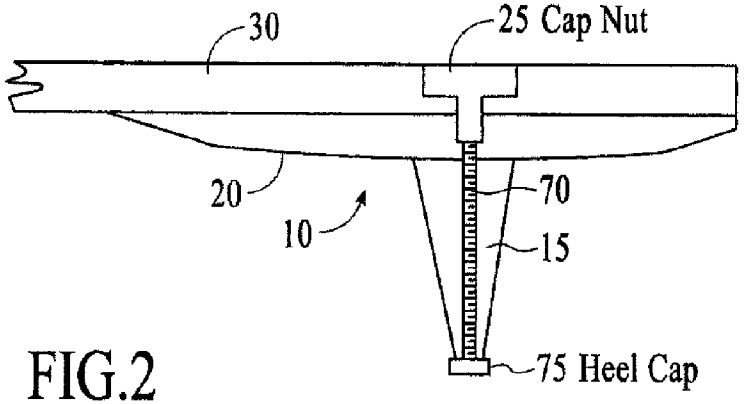
FIG. 2 is a partial side view of FIG. 1 taken substantially on line 2-2 thereof.

Considering now the removable heel 15 and the heel plate 20 in more detail and in reference to FIGS. 2 and 3, the removable heel 15 of such embodiments has an axial bore 80 (FIG. 3) formed within its longitudinal axis that extends from the bottom to the top of the removable heel 15 and further extends through the bottom and top of the removable heel 15. The axial bore 80 serves to receive and support the threaded rod 70 (FIG. 2) therein. A boss 100 is provided in some embodiments at the top of the removable heel 15 and disposed in communicating relationship with the axial bore 80.

Considering now the threaded rod 70 in more detail and with reference to FIG. 3, the threaded rod 70 can be formed of a rigid metallic or plastic material having threads formed thereon. The threaded rod 70 further includes a heel cap 75 which can serve a number of different functions. First, the heel cap 75 can facilitate insertion of the threaded rod 70 within the axial bore 80 of the removable heel 15. Second, the heel cap 75 further facilitates rotation of the threaded rod within the axial bore 80 by the user (not shown). Third, the heel cap 75 in some embodiments provides support for the removable heel 15 when the collapsible shoe 10 (FIG. 1) is being worn by the user (not shown) as the heel cap 75 will be in direct contact with the ground. Since the heel cap may be in direct contact with the ground, the heel cap may be formed of a durable material, such as rubber or plastic.

Considering now the heel plate 20 in more detail and with continued reference to FIGS. 2 and 3, the heel plate 20 can be interposed between the removable heel 15 in the base 30 (FIG. 2). The heel plate 20 of some embodiments includes an axial bore 85 along the short axis of the heel plate 20 as best shown in FIG. 3. The axial bore 85 of the heel plate 20 serves to receive both a boss 100 of the removable heel 15 and the threaded rod 70 passing from the axial bore 80 of the removable heel 80. In this way, the threaded rod 70 may pass completely through the axial bore 85 from the axial bore 80 to be received by a cap nut shown generally at 25 (FIG. 2).

With reference to FIG. 3, the cap nut shown 25 of the illustrated embodiment includes a cap portion 90 and a nut portion 95. The nut portion 95 can be formed of a metallic or plastic threaded material for threadably receiving the threaded rod 70. Moreover, as best shown in FIG. 2, the cap nut 25 of some embodiments is disposed within the base 30 where the cap portion 90 may be flush with or disposed slightly below the top surface of the base 30 of the collapsible shoe 10 so that the user's heel (not shown) may not touch or be bothered by the cap nut 25. The nut portion 95 of the cap nut 25 extends downwardly from the cap portion 90 through the base 30 so that the threaded portion of the nut portion 95 may be accessible from the bottom of the base 30 and may threadably receive the threaded rod 70.

Considering the assembly of the collapsible shoe 10 in more detail and with reference to the embodiment illustrated in FIGS. 1-3, the user may first place the heel plate 20 onto the bottom surface of the base 30. This may be best accomplished by turning the base 30 upside down so that the heel plate 20 may rest onto the bottom surface of the base 30 by gravity. The axial bore 85 of the heel plate 20 may then be axially aligned with the nut portion 95 of the cap nut 25. The removable heel 15 may then be placed onto the heel plate 20 and the boss 100 placed within the axial bore 85 of the heel plate 20 so that the axial bore 80 of the removable heel 15 is placed in axial alignment with both the axial bore 85 of the heel plate 20 and the nut portion 95 of the cap nut 25.

Still referring to the embodiment illustrated in FIGS. 1-3, the threaded rod 70 may then be inserted into the axial bore 80 of the removable heel 15 through the bottom of the removable heel 15 and pass entirely through the axial bore 80 and then through the boss 100 into the axial bore 85 of the heel plate 20. The threaded rod then continues to be inserted into the nut portion 95 of the cap nut 25. When the threaded rod 70 engages the nut portion 95 of the cap nut 25, the user then may rotate the threaded rod 70 using the heel cap 75 to facilitate rotation until the threaded rod 70 is threadably secured within the cap nut 25. After the threaded rod 70 is threadably secured within the cap nut 25, the heel cap 75 will then be positioned abutting the bottom surface of the removable heel 15. In addition, the heel plate 20 and the removable heel 15 may be rigidly secured between the heel cap 75 and the base 30.

Figure 4:
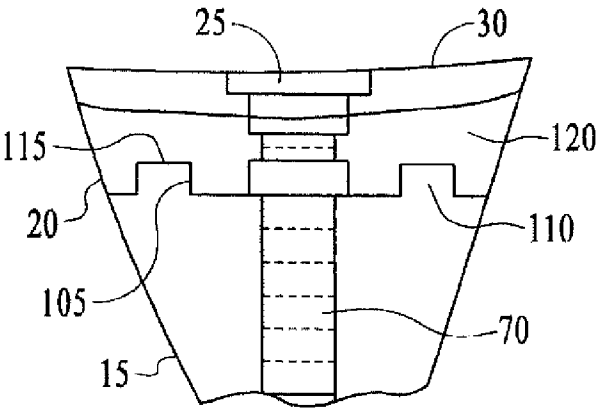
FIG. 4 is a partial sectional view of FIG. 1 taken substantially on line 4-4.

Considering the construction of the removable heel and the heel plate 20 in more detail and with reference to FIG. 4, the removable heel 15 further includes a pair of integral extensions or projections, such as integral projections 105 and 110 extending from the top surface of the removable heel 15. The projections 105 and 110 help to prevent rotation of the removable heel 15 when attached to the heel plate 20. The integral projections 105 and 110 are adapted to be received by two corresponding bores 115 and 120 formed within the heel plate 20 at the bottom surface thereof. The bores 115 and 110 are generally shown at 115 and 120, having the integral projections 105 and 110 inserted therein.

In operation, when the removable heel 15 is disposed abutting the bottom surface of the heel plate 20, the integral projections 105 and 110 are then inserted and received by the bores 115 and 120. Thus, when the threaded rod 70 is inserted into the cap nut 25 and tightened, the removable heel 15 is secured flat against the heel plate 20 and the projections 105 and 110 and held tightly within the bores 115 and 120. In this way, the removable heel 15 may not be inadvertently loosened or removed from the heel plate 20 of the shoe 10. Furthermore, the removable heel 15 may not rotate since the integral projections 105 and 110 may not permit this to occur since they inhibit rotation of the heel 15 relative to the heel plate 20.

Figure 5:
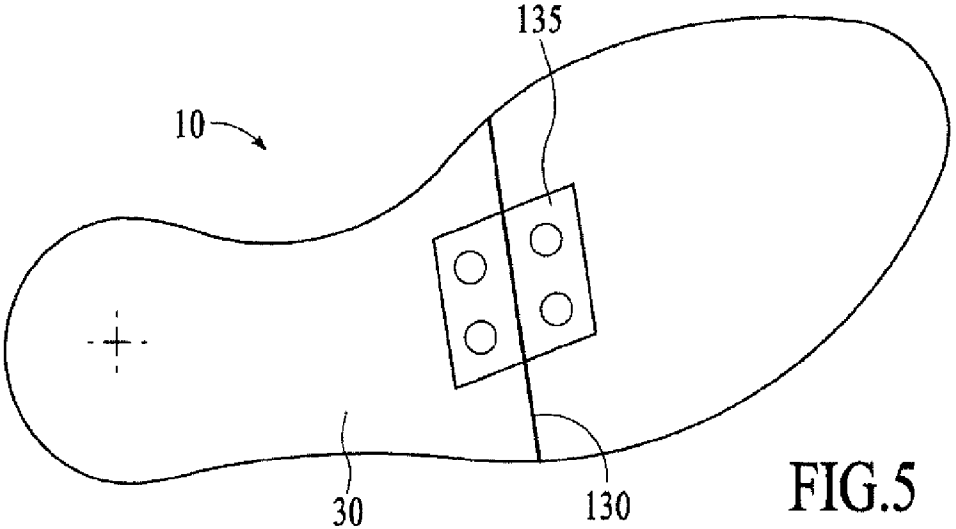
FIG. 5 is a bottom plan view of one embodiment of a collapsible shoe FIG. 5.
Figure 6:
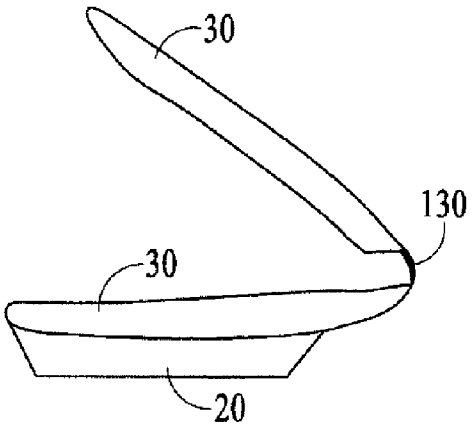
Figure 7:
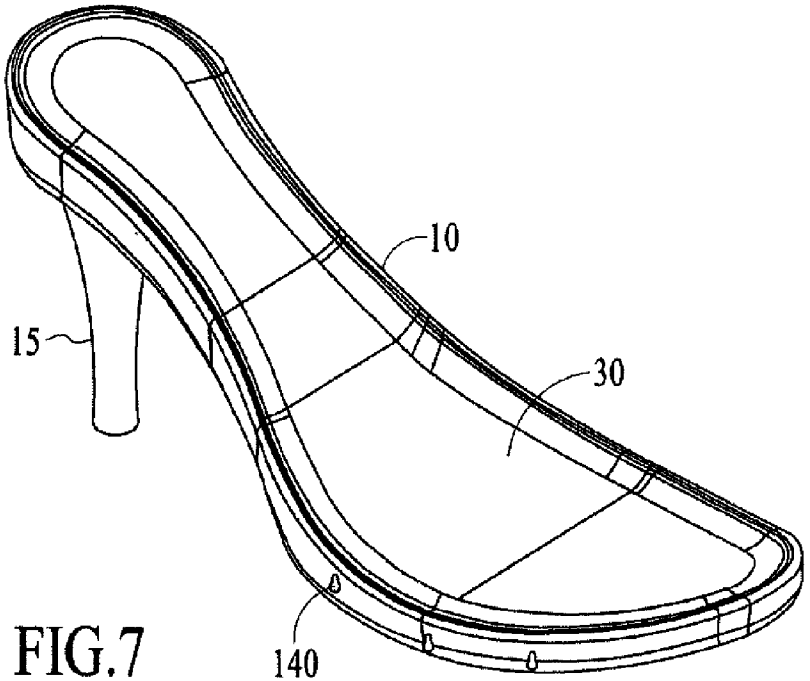
FIG. 7 is a perspective view of one embodiment of a collapsible shoe.

In another embodiment of the present invention and with reference to FIG. 5, the collapsible shoe 10 can be further reduced in size for storage or travel purposes by including a slit 130 formed within the base 30. The slit 130 permits the base 30 of the collapsible shoe 10 to fold back upon itself as best shown in FIG. 6. To facilitate this operation, a hinge 135 can be affixed to the bottom surface of the base 30 as best shown in FIG. 5. The center of the hinge 135 of the illustrated embodiment is disposed over the slit 130 so that the hinge may permit the base 30 to fold back upon itself. The hinge 135 then serves to permit folding and collapsing of the base 30 while preventing the two sections of the base 30 separated by the slit 130 from separating by an extensive distance where they could then be misplaced.

In operation, with reference to FIGS. 5 and 6, after the user (not shown) is finished using the collapsible shoe 10, the user removes the shoe 10 and the removable heel 15 and then folds the base 30 of the collapsible shoe back upon itself as best shown in FIG. 6. When the user desires to utilize the collapsible shoe 10 once again, the collapsible shoe 10 is unfolded via the hinge 135 so that the base 30 is generally flat as best shown in FIG. 5. At this point, the removable heel 15 would then be attached to the base 30 of the collapsible shoe 10 as described heretofore.

Figure 12:
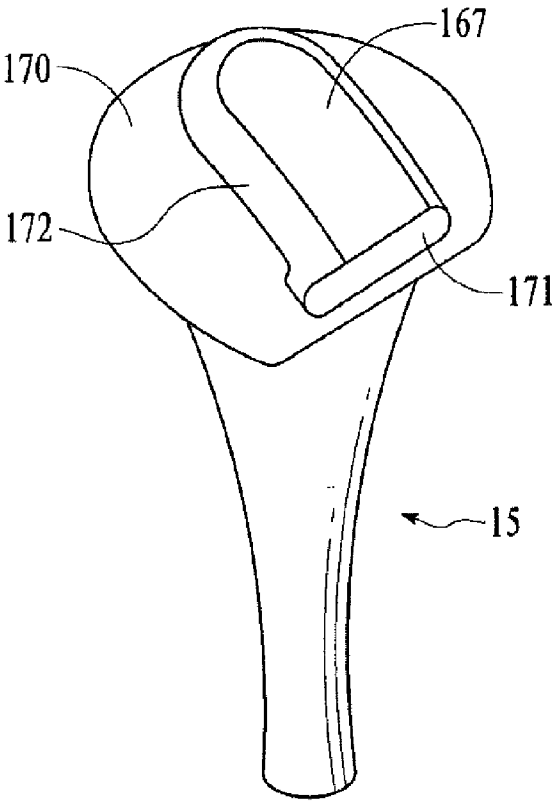
FIG. 12 is a perspective view of FIG. 11 illustrating one embodiment of a removable heel
Figure 11:
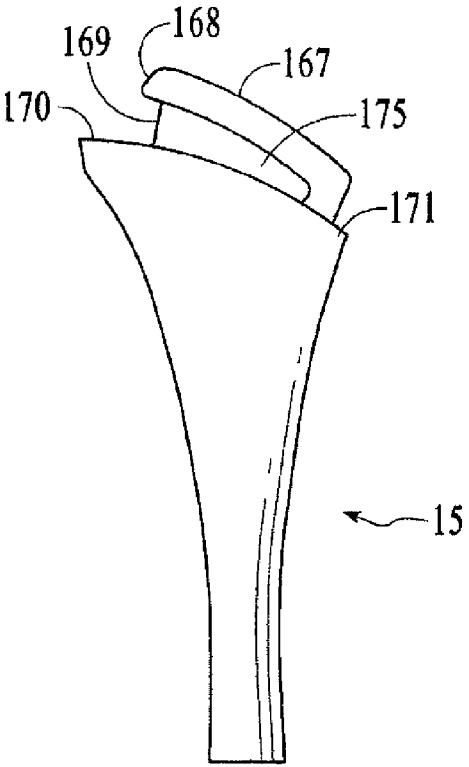
FIG. 11 is a side elevational view of one embodiment of a removable heel.

Consider the construction of the removable heel in FIGS. 11 and 12, the heel is made of the plastic, metal, wood, or like material. The head of the heel consists of a fillet raised edge that will be identical in all heels. The head is attached to a larger flatter area 170 known as the attachment site to the base. Once the heel is inserted into the cavity 173, the heel attachment site 170 will lay against the base attachment site 188 with a seamless edge. The upper portion of the heel will be the same in each heel; however the lower portion of the heel 15 will change aesthetically in shape, color, size, fabric covering, material, thickness, etc. There is a steel rod 190, within the heel for stability and structure. You can't see the rod from the outside. A heel cap 75 will be attach to the end of the heel, covering the steel rod from the bottom. Changing the heels in the sole, allows the consumer to interchange a thin heel, for a wedge heel or a pump heel. The shapes and styles of the heels that will be created to interchange with the removable heel 15 will be determined by fashion trends and should not be limited to any said configuration in this patent.

In some embodiments, the heel head 167 may vary in shape or design, depending on the shape and design of the base attachment sight. The two pieces, the heel 15 and the shoe 10 will be designed in unison so that they fit into each other. The heel head 167 may be more circular, rectangular, or square in each model depending on the particular design of the shoe. This will depend on fashion trend.

In some embodiments the heel head 167 will be extended to fit on a wedge heel (not pictured). The surface area of the heel cap 75 is much larger as is the shape of the entire heel 15. When the sole of the shoe is made to accommodate a wedge, the attachment sight for the sole 188 will be larger in dimensions, as will the entire cavity 173 and the heel head 167. In some embodiments, the same locking mechanism will be used and the same design concept will be used. In some embodiments, the components will just be larger than those pictured and shaped slightly different.

In some embodiments, as shown in FIG. 10, the heel enters the bottom of the sole. In this particular drawing, the heel is shown entering the sole from the front of the shoe 10 to the back of the shoe. Thus, adding more stability when the consumer walks on the heel. This approach minimized the chance of the heel 15 coming off the sole from the back. In some embodiments the heel may slide in from the back of the sole to the front of the sole. The spring loaded retaining button 163 would be moved to the back of the cavity 173 to enable it to be depressed by the heel as it enters the cavity.

Figure 9:
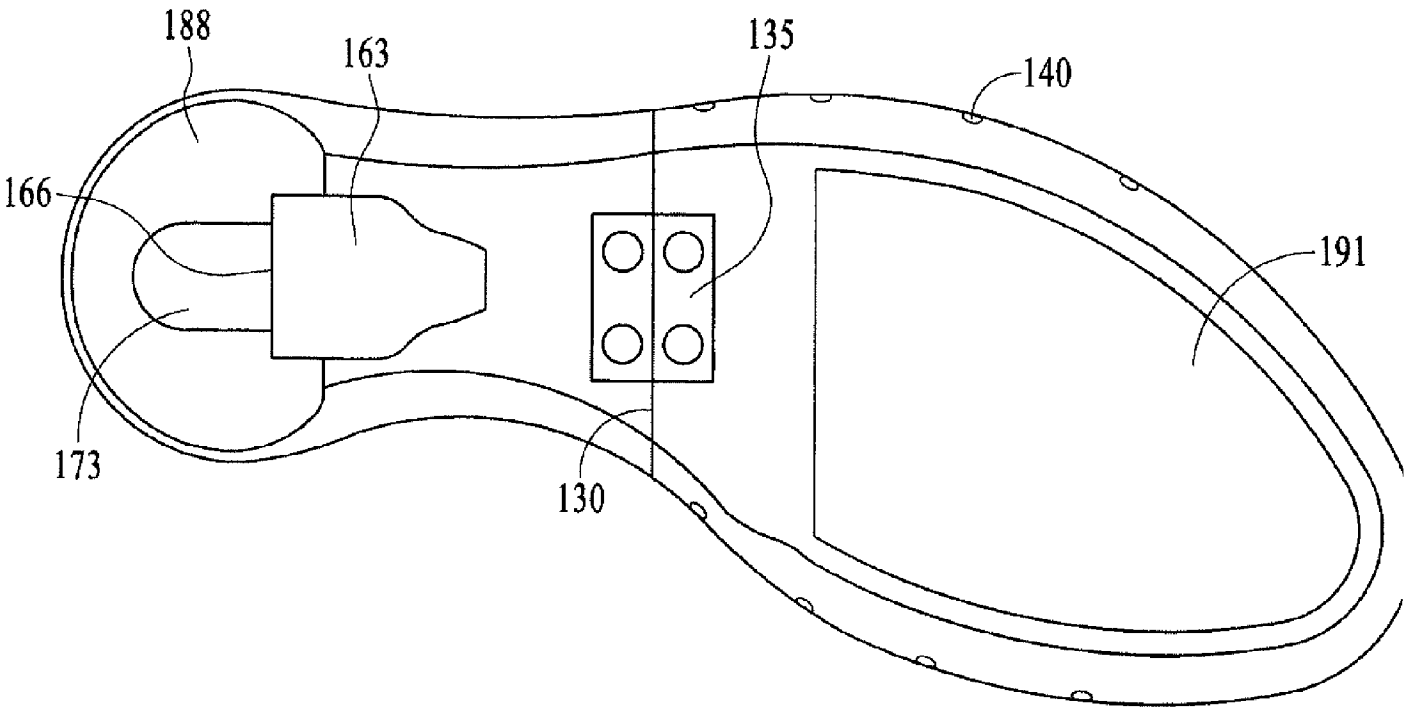
FIG. 9 is a bottom plan view of one embodiment of a collapsible shoe

In some embodiments, the spring loaded heel-retaining button 163 in FIG. 9 will be decorated or ornamented according to fashion trends. It will also vary in size, color, material, and shape. The size of the spring will also vary in size, material, color, and strength.

In one embodiment, the spring loaded heel-retaining button 163 is shown in FIG. 8, is a separate piece made to fit into the sole. The button 163 is connected to the sole via 162 a clip attaching the button to the sole via small screws 161 but not limited to screws, pins, or like structures. In one embodiment the button is molded into the construction of the sole (not pictured), and 162 is not needed. The spring 165 is then attached to the sole under the heel release button. The spring loaded retaining button is used to release and attach the heel 15.

Consider in FIG. 8, how the front heel retaining plate 171 rest against 166 the front of the button when the heel is completely in the cavity. In some embodiments, the heel will be completely inside the cavity in order for the spring loaded retaining button to release and raise up flush with the heel front 171.

In some embodiments, as shown in FIG. 10, the construction of the sole's heel cavity is designed to mirror the exact dimensions of the heel head 167. There can be a small ridge on the inside of the cavity 173 that allows for the filleted edges of the heel neck to dip down lower into the cavity. This can create an added locking mechanism because once the heel is lowered in to the cavity, it may not be pulled up because the neck of the heel is trapped underneath the ridge in some embodiments.

Figure 13:
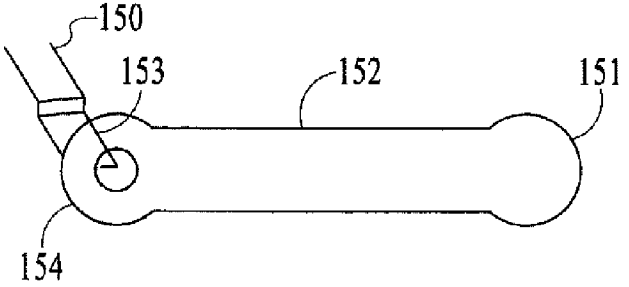
FIG. 13 is a perspective view of one embodiment of a removable straps mechanism

In some embodiments, FIG. 13, the clasp 152 has two sides. One end of the clasp 151 can be inserted into the holes 140 of the sole. The other end of the clasp 154, can have a hole in it, where a jumpring 153, or like configuration, is inserted through the hole to attach the strap 35. In some embodiments, the strap is fed thru the jumpring and sew on itself to secure the latch to the strap. The size of the hole 153 in the clasp may vary in size, shape, or location depending on design style. The shape of 151 and 154 of the clasp is altered in some embodiments. In some embodiments the ends are square or rectangular. The design of this clasp is not limited to the shape, circular design, measurements, or material.

In one embodiment, FIG. 14, the strap retainer 140 are on the sides of the shoe. One strap retainer is divided into three parts; the bottom portion of the strap retainer 143, the middle portion of the strap retainer 142, and the upper portion of the strap retainer 141. The three parts are slightly different dimensions. The bottom retainer 143 is where the clasp end 151 is inserted into the shoe. The clasp can be inserted into the side of the shoe 10 so that only the 154 end of the clasp is exposed. In some embodiments, the depth of the strap retainer is molded into the side of the shoe, and is determined by the clasp length. The clasp end 151 enters the bottom strap retainer and is moved past 142, which is a smaller strap retainer dimension. In some embodiments, the smaller dimensions can create tension on the clasp as it moves past the strap retainers. Then the clasp is forced by direct upward pressure into the smallest of the strap retainers 141, where it snaps into place, in some embodiments. Strap retainer 141 is just big enough for the 151 clasp end to fit into the retainer, this creates side tension on the clasp and keeps the clasp in the strap retainer. In FIG. 14, 144 illustrates the clasp in the upward, locked position in one embodiment. The fabric is attached to the clasp and can be secured to the sole of the shoe. When the consumer wants to remove the strap, the consumer can push downward on the clasp in position 141 and move the latch past 142 into 143 in some embodiments.

In some embodiments, 140 can consists of just one chamber instead of three spaces like 141,142,143. The dimension of the strap retainer is slightly larger than the clasp end 151. The consumer can push the clasp end 151 into the strap retainer comprising of one compartment, and the side tension can make it difficult to slide the clasp past the hole. This side tension is what will secure the clasp to the shoe in some embodiments.

In some embodiments the size, shape, design, and material of the strap retainer can be altered for design style. The dimensions of the strap retainer are dependent upon the size and shape of the clasp. The shape of the clasp is determined by fashion trend and designer interpretations. It is also determined by the material used to create the clasp which can range from plastic, metal, wood, nylon, or other synthetic material.

In review, the purpose of creating an interchangeable shoe is to enable the consumer to own one pair of shoes (soles) and purchase heels and straps separately to change the style of your shoes. In some embodiments of the interchangeable shoe, you can change a thin, stiletto heel for a thicker/wedge heel. In some embodiments you can change one thick strap for a strap comprising of 3 or 4 decorative straps. In some embodiments, the hinge in the sole will enable the consumer to fold the sole in half, to pack the shoe easier for traveling. In some embodiments, the heels and straps will come in variety of colors, shapes, material types, and style. The consumer will be able to interchange the straps and heels per fashion trends or per functionality.

It will become apparent to those skilled in the art that the disclosed embodiments of the invention are subject to a variety of modifications without departing from the invention and such variations are assumed to be within the skill of those in the art such that they are included in this disclosure.

Figure 15:
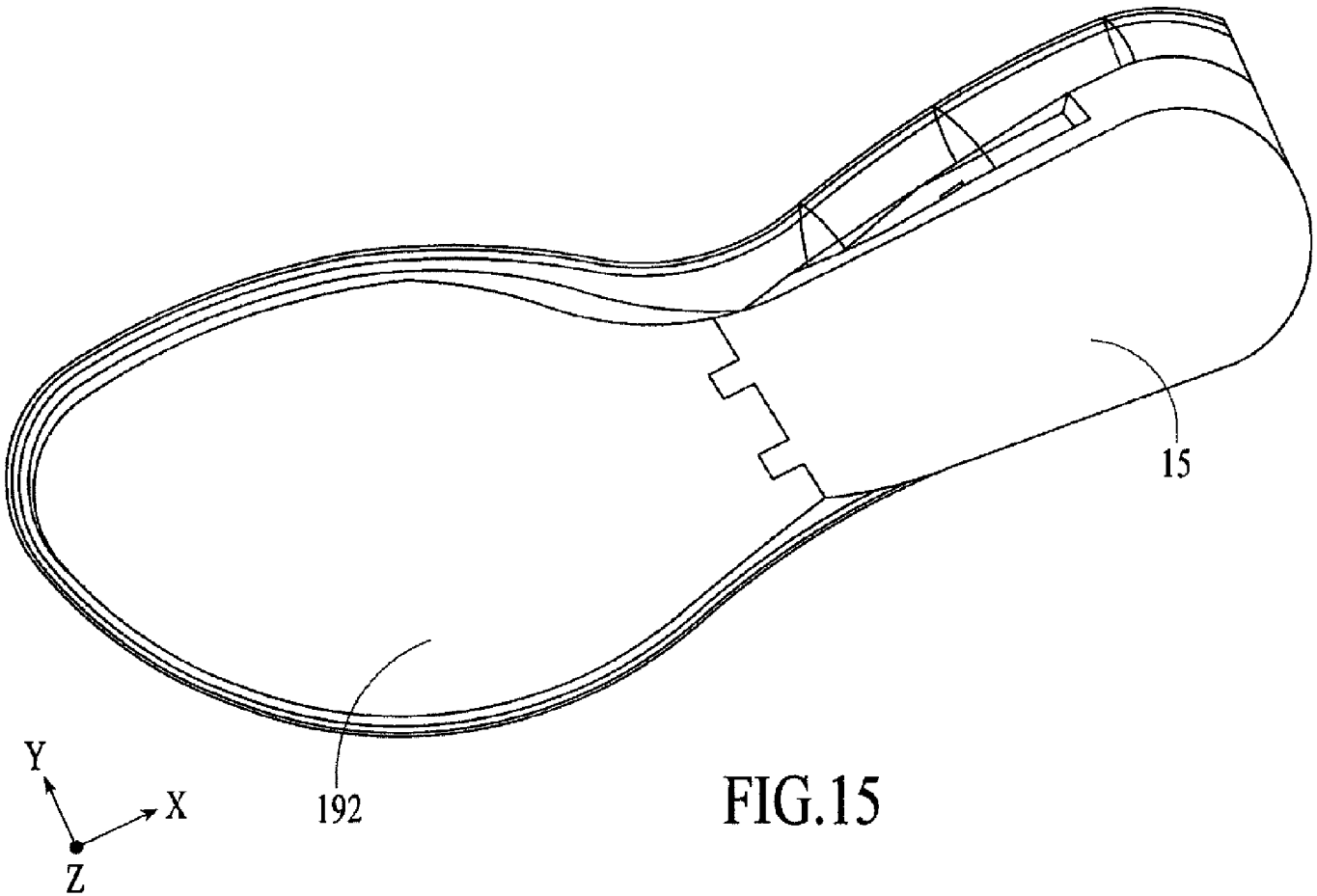
FIG. 15 is a bottom view of a removable platform.
Figure 17:
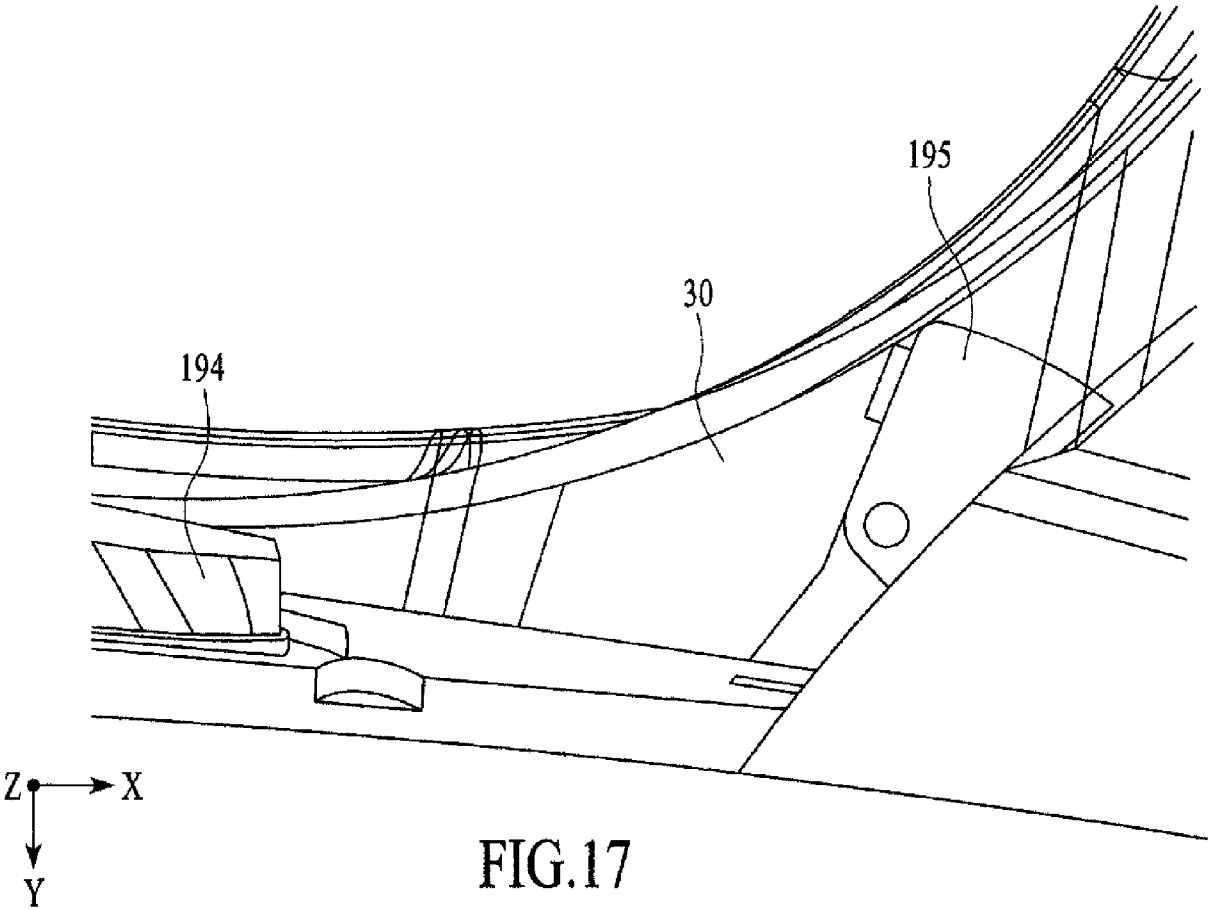
FIG. 17 is a view of a small platform.

In some embodiments, the platform is removable from the base via a spring loaded button 195. Once the button 195, is depressed the platform is twisted to one side and released. In FIG. 15, 192 demonstrates one such removable platform. Note 196, are the guides that are used for the interchangeable platform to get and stay in place. The platform is reattached by lining up the cog 194 on the inside of the platform with the hole in the bottom on the base. The platform is in place once the guide is lined up on each side of the lever (spring loaded button, 195). The same cog design is seen in both mates: the base and platform. The cog is lined up and the platform is twisted into place. The button is depressed upon twisting. FIG. 15, In this particular embodiment, the removable wedge heel is attached after the platform in attached and adds security to the removable platform. The platform is removable to increase or decrease the height of the shoe. The platforms may be constructed in several heights. FIG. 17 shows a small platform, but several heights exist. Once the desired platform height is attached, the removable heel that corresponds to that height will be inserted into the shoe. In some embodiments, this is how the interchangeable platforms and interchangeable heels can add or subtract height to a shoe.

Figure 16:
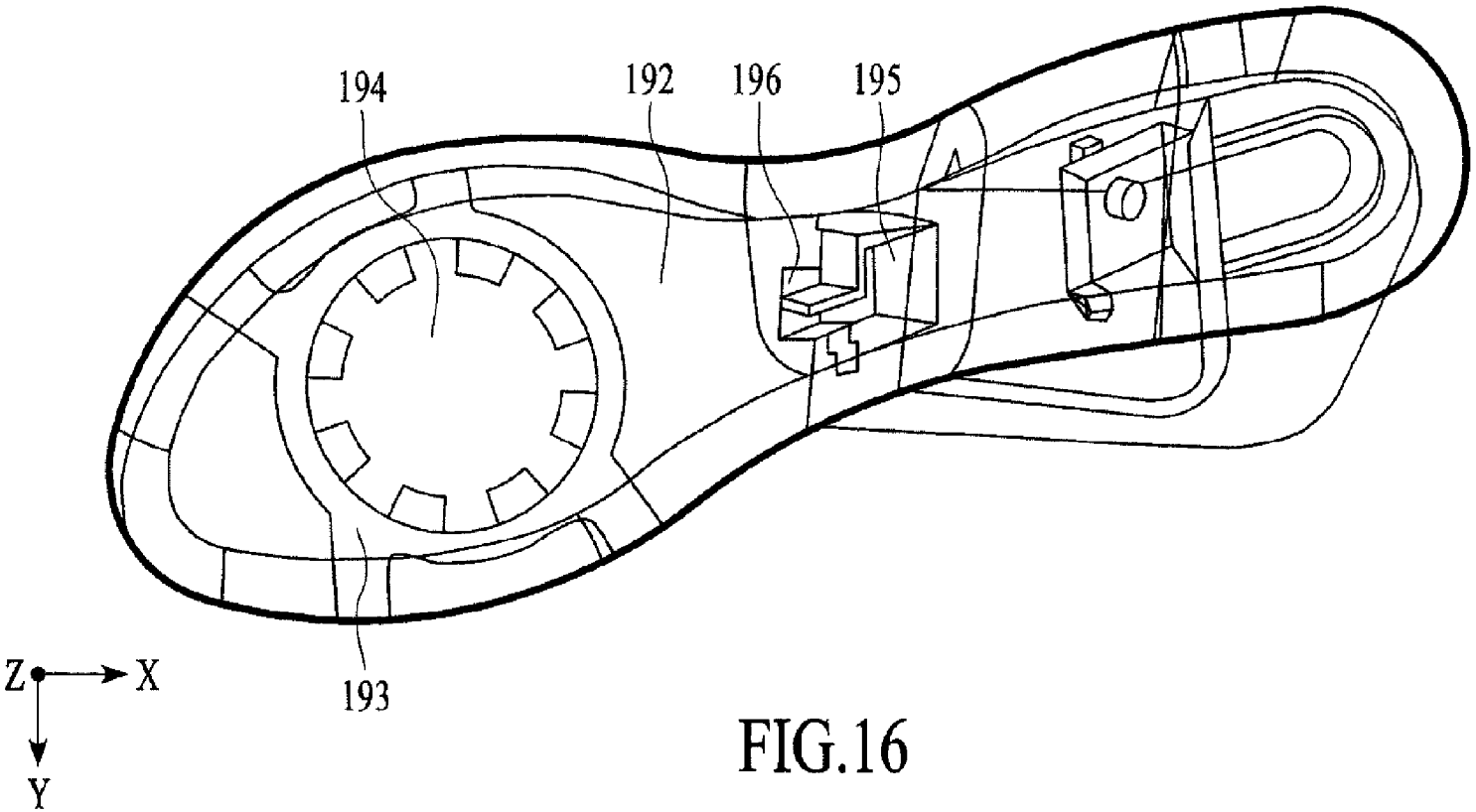
FIG. 16 is a perspective view of an interchangeable platform with a strap attachment.

In some embodiments, the interchangeable platforms also feature a strap attachment site, 193 in FIG. 16. There is a strap cut-out on the inside of the removable platform. The cut-out dictates where the straps will be positioned. Once the platform is attached to the base, the straps will be sandwiched in between the platform and the base. This will ensure that the strap will not come off the foot or the base.

Figure 18:
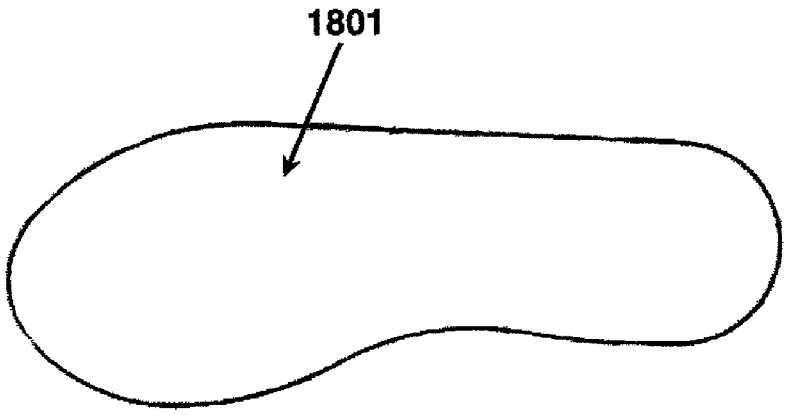
FIG. 18 is a perspective view of one embodiment of a shoe base.
Figure 18A:
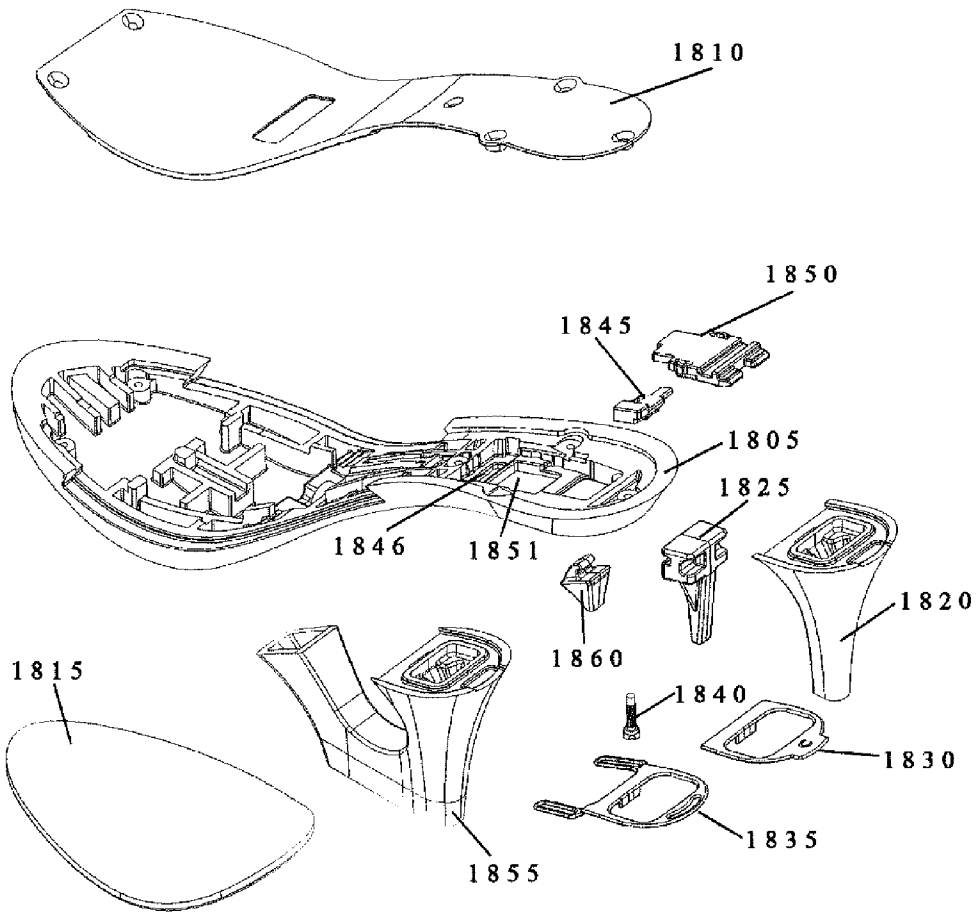
FIG. 18A is an exploded perspective view of one embodiment of a collapsible shoe.

Another embodiment of a collapsible shoe having a removable heel is illustrated in FIG. 18A. FIG. 18A specifically illustrates an exploded perspective view of a several components of one embodiment of a collapsible shoe. These components include a base 1805, a base plate cover 1810, a sole 1815, a removable heel 1820, a heel insert 1825, a removable heel blank 1830, a removable ankle strap attachment piece 1835, a reinforcement cylinder 1840, a horizontal lock lever 1845, a vertical lock lever 1850, a removable wedge 1855, and a wedge support insert 1860.

A detailed perspective view of the removable heel 1820 of the embodiment shown in FIG. 18A is illustrated in FIG. 188. When the removable heel 1820 is in place, one of either the removable heel blank 1830 or the removable ankle strap attachment piece 1835 may be interposed between the removable heel 1820 or removable wedge 1855 and the base 1805. The removable heel blank 1830 is similar to the heel plate 20 shown in FIG. 2 and FIG. 3 in that it may serve to support the removable heel 1820 and to rigidly and releasably mount the removable heel 1820 to the base 1805.

Figure 18B:
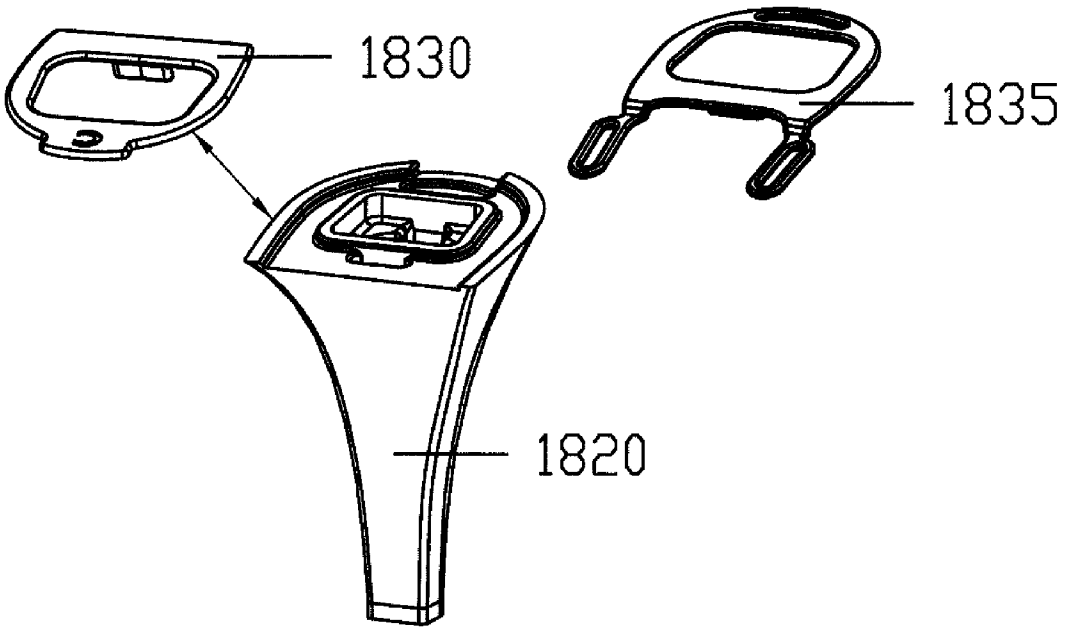
FIG. 18B is a perspective view of one embodiment of a removable heel and a removable heel blank and removable ankle strap attachment piece.
Figure 18C:
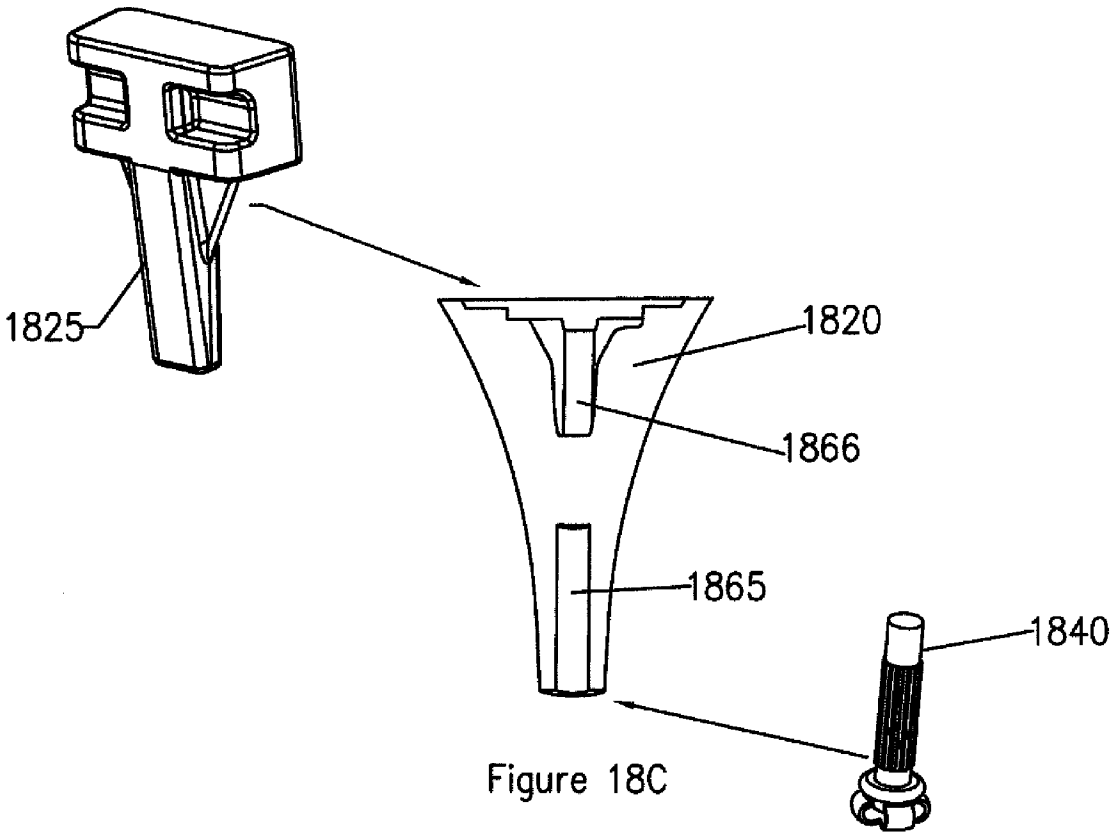
FIG. 18C is one embodiment of a removable heel including one embodiment of a reinforcement cylinder and a heel insert.

As can be seen in FIG. 18C, the removable heel 1820 may include a first and second cavity 1865 and 1866. The first cavity 1866 may accommodate a heel insert 1825. The heel insert 1825 fits into a base cavity on the bottom of the heel and the heel insert 1825 facilitates the locking and unlocking of the removable heel 1820 to the base 1805. The heel insert 1825 may be permanently secured to the first cavity 1866 with a bonding agent such as glue. The second cavity 1865 may be an axial bore at the bottom of the removable heel 1820. This second cavity 1865 may accommodate a reinforcement cylinder 1840 for added stability in the heel similar to the steel rod 190 shown in FIG. 8. The reinforcement cylinder 1840 may be permanently secured to the second cavity 1865 with a bonding agent such as glue.

The removable heel 1820 may also be interchanged with a removable wedge 1855 in order to provide a different look and style. The removable wedge 1855 may also include a cavity that can accommodate the same heel insert 1825 as the removable heel 1820 in the same manner in order to assist in locking and unlocking the removable wedge 1855 to the base 1805. A wedge support insert 1860 may slide into a front recessed cavity in the removable wedge 1855 in order to provide support and stability when the removable wedge is attached to the base 1805. The wedge support insert 1860 may be permanently affixed to the front recessed cavity of the removable wedge 1855 with a bonding agent. The wedge support insert 1860 may couple to a wedge support slot 1890 shown in FIG. 18F when the removable wedge 1855 is secured to the base 1805.

Figure 18D:
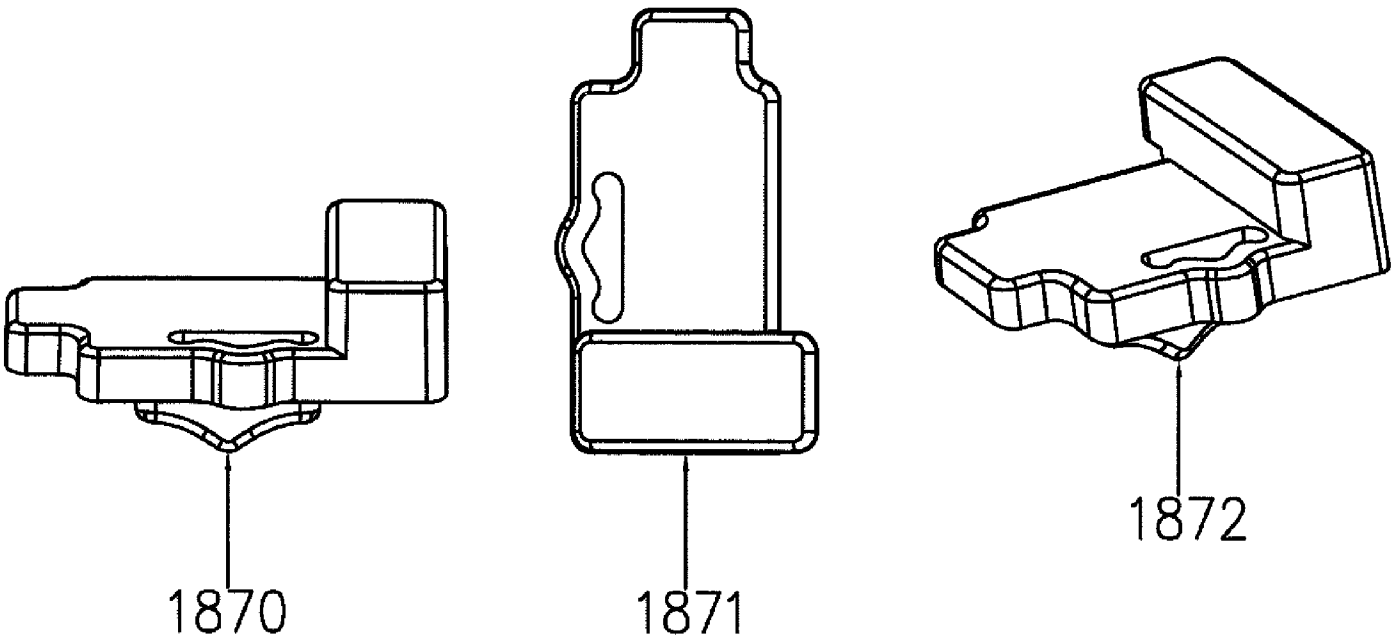
FIG. 18D illustrates a side view, top view, and perspective view of a horizontal lock lever.
Figure 18E:
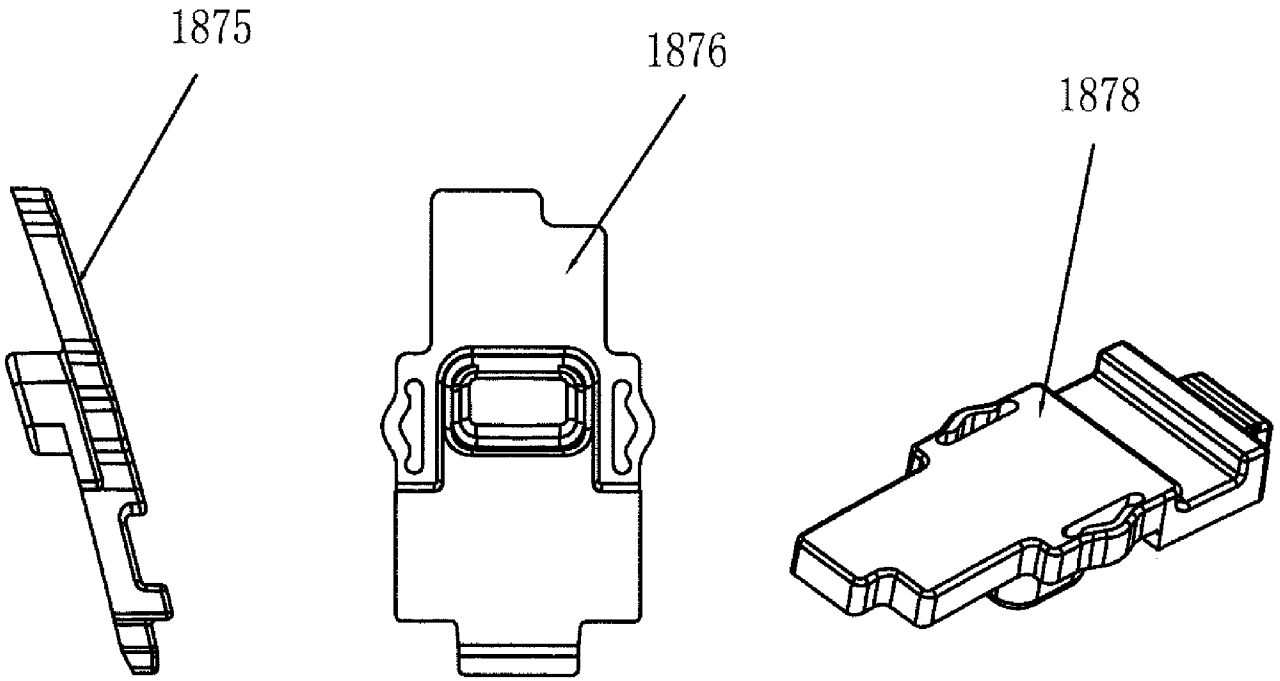
FIG. 18E illustrates a side view, top view, and perspective view of a vertical lock lever.

To secure the removable heel 1820 or removable wedge 1855 to the base 1805 of the collapsible shoe, one embodiment of the collapsible shoe may use a double lock mechanism in conjunction with the heel insert 1825 in order to ensure the removable heel 1820 or wedge 1855 does not inadvertently become insecure while a user is wearing the collapsible shoe. The double lock mechanism may incorporate a horizontal lock lever 1845 that locks and unlocks a vertical lock lever 1850 that interact with the heel insert 1825. The horizontal lock lever 1845 may be aligned with a horizontal lock slot 1846 and the vertical lock lever 1850 may be aligned with a vertical lock slot 1851 in the base 1805. FIG. 18D illustrates a side 1870, a front 1871 and a perspective view 1872 view of the horizontal lock lever 1845. FIG. 18E illustrates a side 1875, a front 1876 and a perspective view 1877 of the vertical lock lever 1850.

Figure 18F:
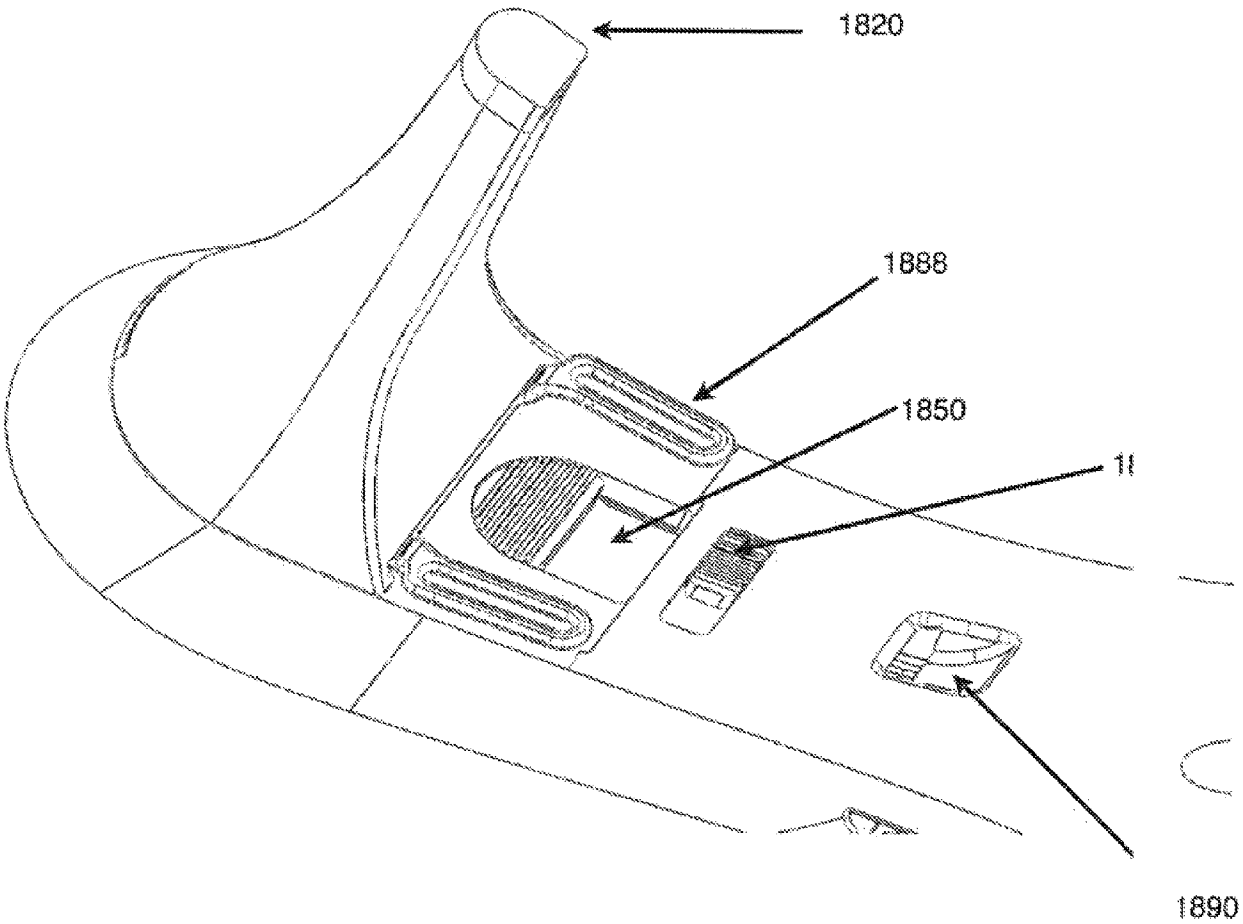
FIG. 18F is a bottom view of one embodiment of the collapsible shoe.

As illustrated in FIG. 18F, when the heel is inserted into the base cavity and in a locked position, the vertical lock lever 1850 is pushed up toward the removable heel 1820 and the horizontal lock lever 1845 is moved to the right in a lock position. The vertical lock lever 1850 engages the heel insert 1825 to hold the removable heel 1820 in place. When the vertical lock lever 1850 is in the lock position and engaged with the heel insert 1825, the horizontal lock lever 1850 may be moved in a position that engages the vertical lock lever 1850 so that the vertical lock lever 1850 is not able to move down to an unlocked position. When a user wants to remove the removable heel 1820, the horizontal lock lever 1845 must first be moved to the left, for example, to its unlock position which allows the vertical lock lever 1850 to freely move down to its unlock position. A user can then move the vertical lock lever 1850 down and away from the removable heel 1820 thus freeing the removable heel 1820 and allowing the user to remove it from the base 1805.

It will become apparent to those skilled in the art that the disclosed embodiments of the invention are subject to a variety of medications without departing from the invention and such variations are assumed to be within the skill of those in the art such that they are included in this disclosure.

II. A Shoe Base Having Removable and Interchangeable Upper Straps

According to certain embodiments, there is provided a collapsible shoe base having removable upper straps, the removable straps being attached to the base or sole of the shoe.

Figure 18G:
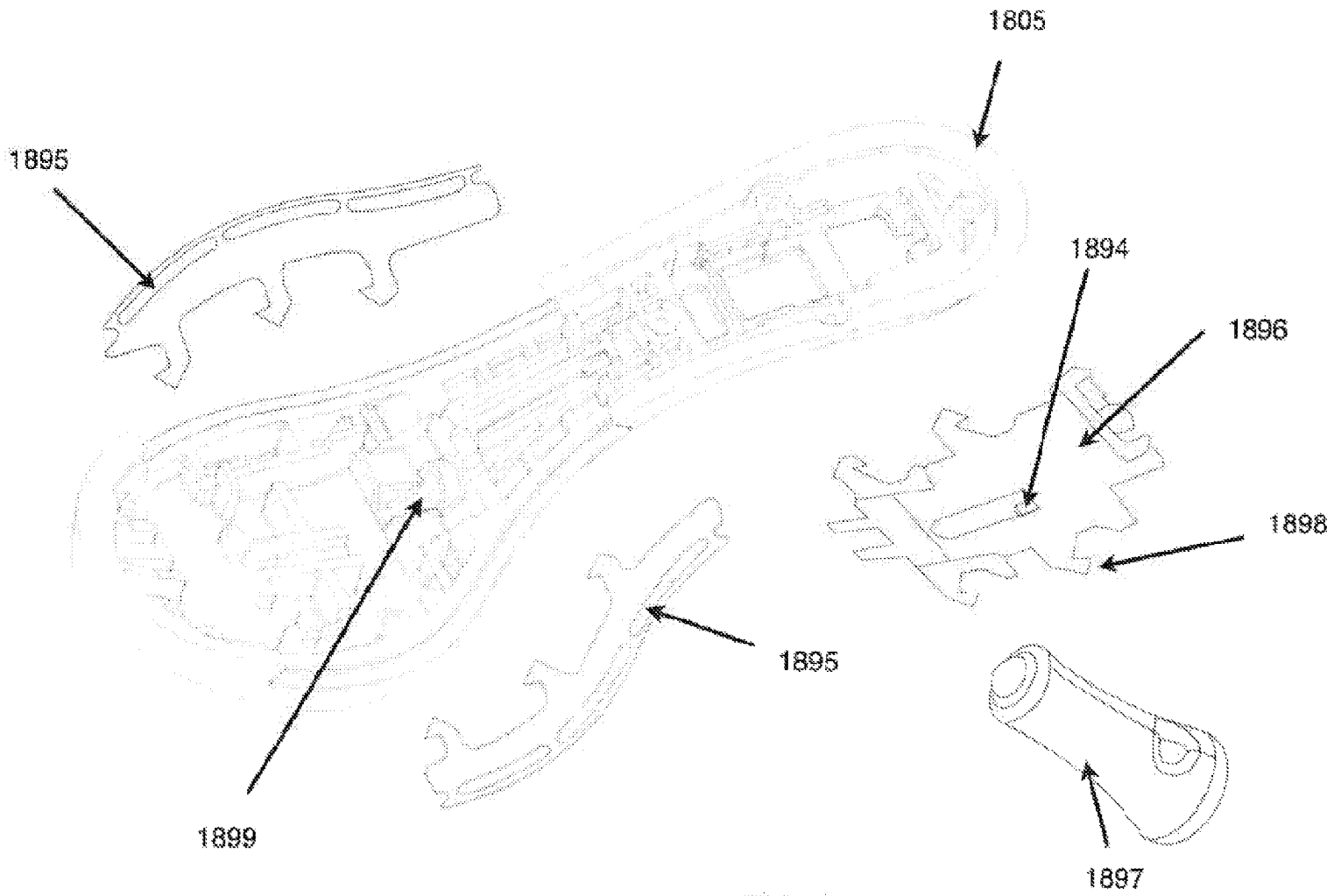
FIG. 18G is an exploded perspective view of one embodiment of a removable strap and a device that secures the removable strap to the base of the collapsible shoe.

FIG. 18G illustrates an exploded perspective view of the base 1805 of one embodiment of the collapsible shoe with removable straps 1895, a removable strap device 1896, and a removable strap button lever 1897. The removable strap device 1896 may be housed within the base 1805 and may include a push button 1894 at an interior center of the removable strap device 1896. When the removable straps 1895 are manually pushed into the sides of the base 1805 the removable strap device 1896 will be forced forward within the base 1805 causing the push button 1894 to be depressed against a wall of the base 1805. When the teeth 1898 have engaged the removable straps 1895, the push button 1894 will cause the removable strap device 1896 to move back into its original position locking the removable straps 1895 in place. When in place, the user may thread straps through slots of the removable straps 1895 for use.

Figure 18H:
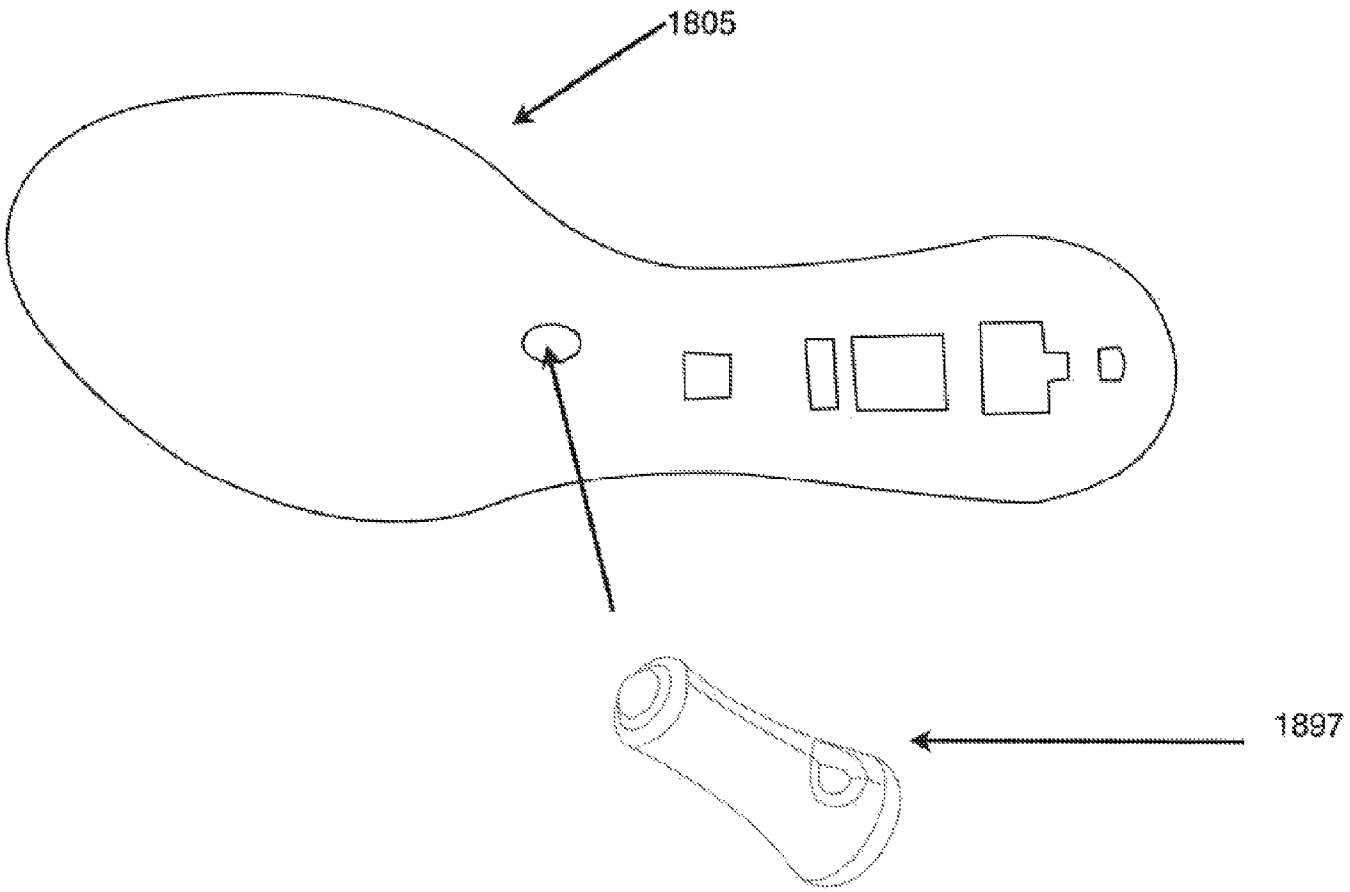
FIG. 18H illustrates the use of a removable strap button lever to disengage a removable strap from the base of the collapsible shoe.

In order to release the removable straps 1895 from the base 1805, the removable strap button lever 1897, for example, may be inserted into hole 1899 as illustrated in FIG. 18H. The hole 1899 is an access point to the removable strap device 1896, which may be pushed forward with the removable strap button lever 1897 disengaging the teeth 1989 so the removable straps 1895 can be pulled out of the base. Once the removable straps 1895 are disengaged and the push button 1894 will cause the removable strap device 1896 to move back to its original locked position. Similar devices such as a pen cap or pencil may also be used to disengage the removable straps 1895 through the hole 1899 in the base.

If a user wishes to add high ankle straps to the collapsible shoe, the user may make use of the removable ankle strap attachment piece 1835 shown in FIG. 18B. The removable ankle strap attachment piece 1835 is shown in place in FIG. 18F where two metal rings 1888 are exposed. Straps may be threaded through the metal rings 1888 as desired by the user.

Figure 19:
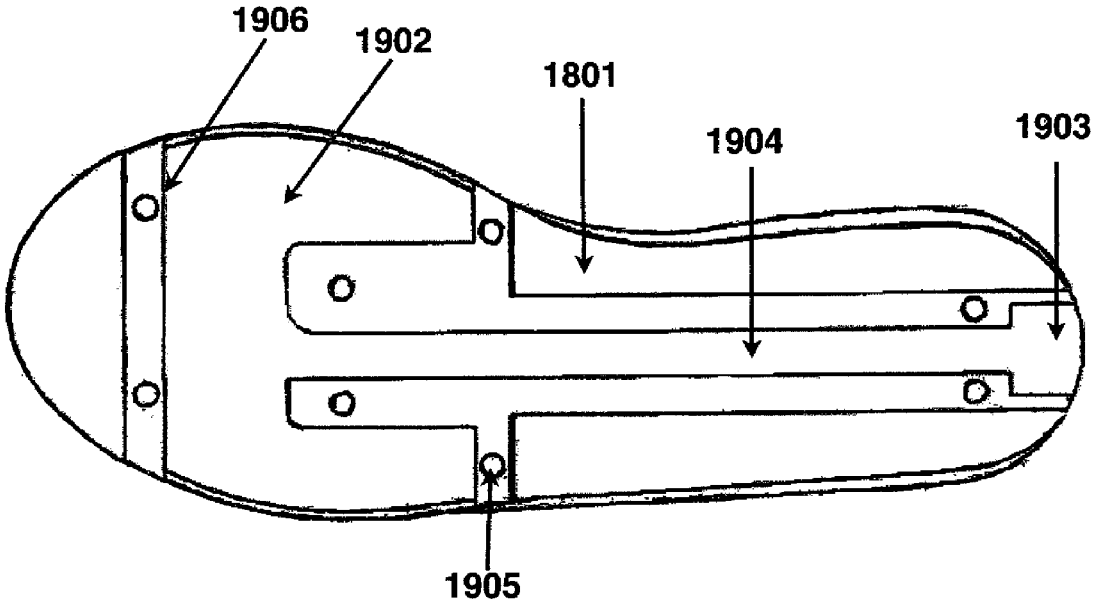
FIG. 19 is a bottom plan view of one embodiment of a shoe base showing the empty cavity of wherein, the strap release lever would be attached.
Figure 20:
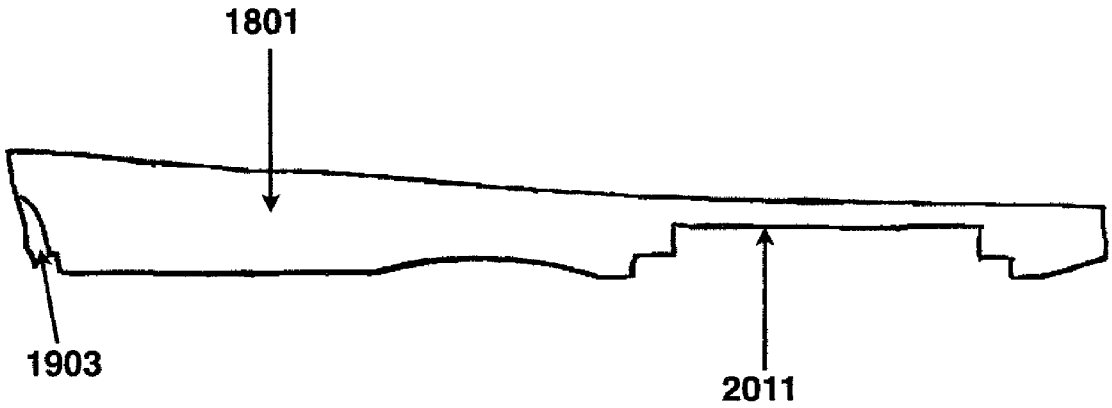
FIG. 20 is a side view of FIG. 1, illustrating the profile of the strap release cavity and the button release cavity before the strap lease lever is attached.
Figure 21:
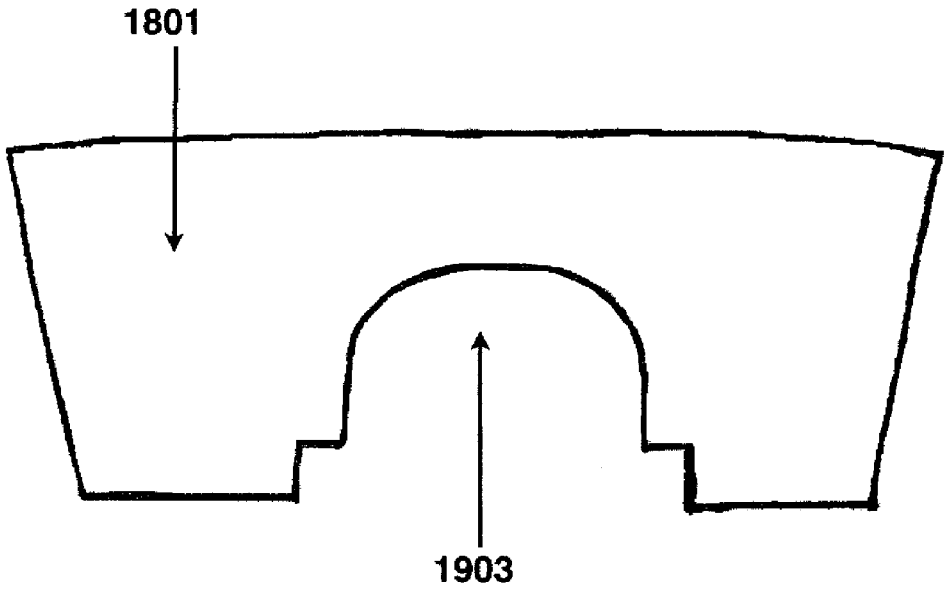
FIG. 21 is a posterior view of the button release cavity illustrating the profile before the release button is secured to the shoe.
Figure 22:
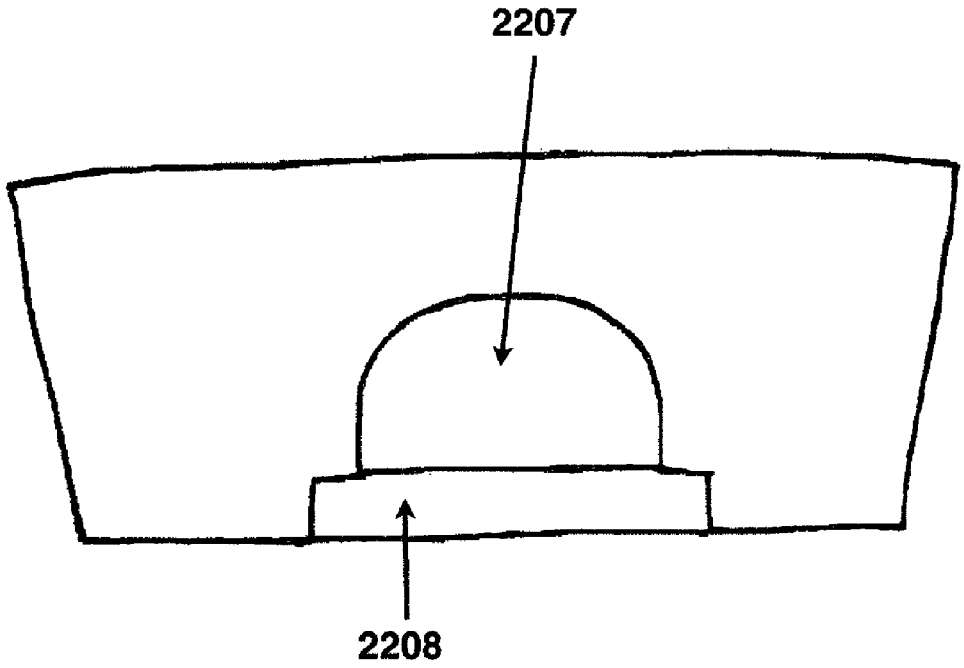
FIG. 22 is a posterior view of the shoe base once the release button is assembled to the shoe base. It illustrates the button in the "rest" position.
Figure 23:
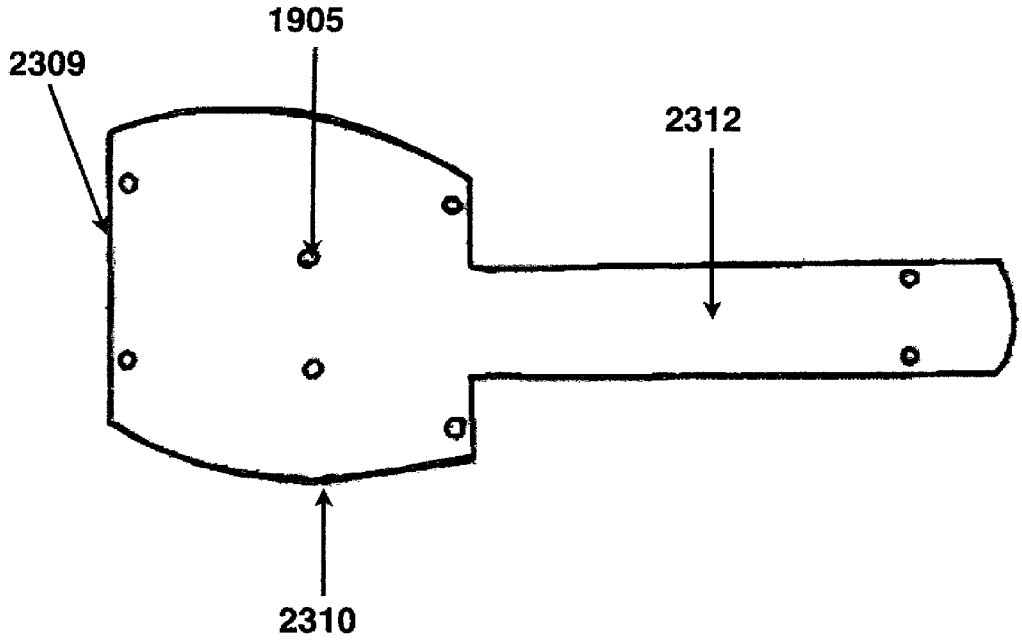
FIG. 23 is a perspective view of the shoe base cover prior to attachment to the base.

FIG. 19 shows a cross section of another embodiment of the shoe base, exposing the cavities that house the quick release mechanism. In some embodiments their can be more cavities, can vary in shape/size, and compartmentalized differently. The cavities shown in FIG. 19, house the strap release mechanism. A base cover 2312, shown in FIG. 23 can then be attached to the shoe base to cover and protect the strap release mechanism. The base cover is attached to the shoe base by any suitable attaching means, such as using screws, pins, plugs, or nails. In some embodiments the base cover is glued or hard pressed to the shoe base.

Figure 27:
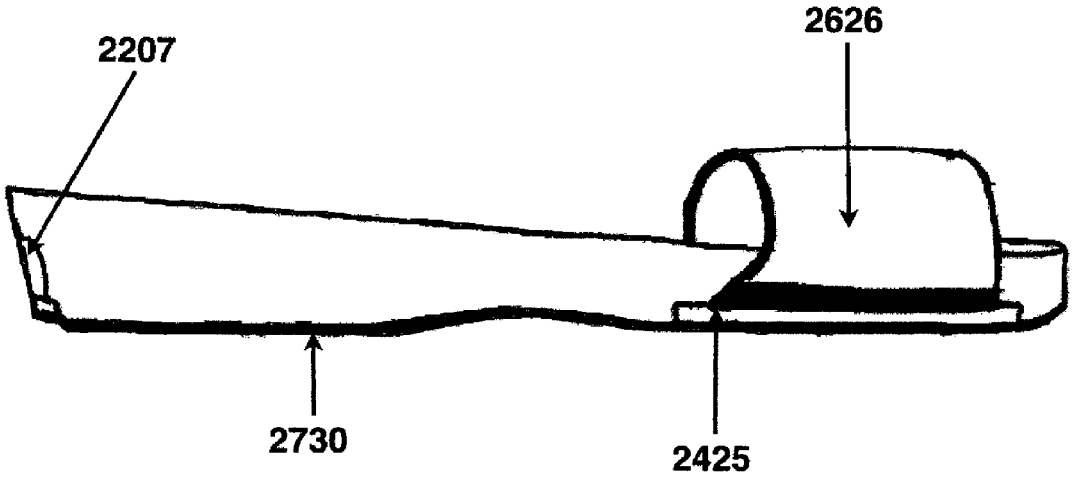
FIG. 27 is a side view of the shoe base with the interchangeable strap attached to the base

The base cover is attached once the quick strap attachment pieces are placed into the cavity to ensure their security and function in the shoe base. The shoe base is then covered, as shown in FIG. 27, with a suitable covering material 2730, such as a piece of rubber, leather, plastic, fabric, or sole-like material to protect all working mechanisms in the shoe base.

Figure 25:
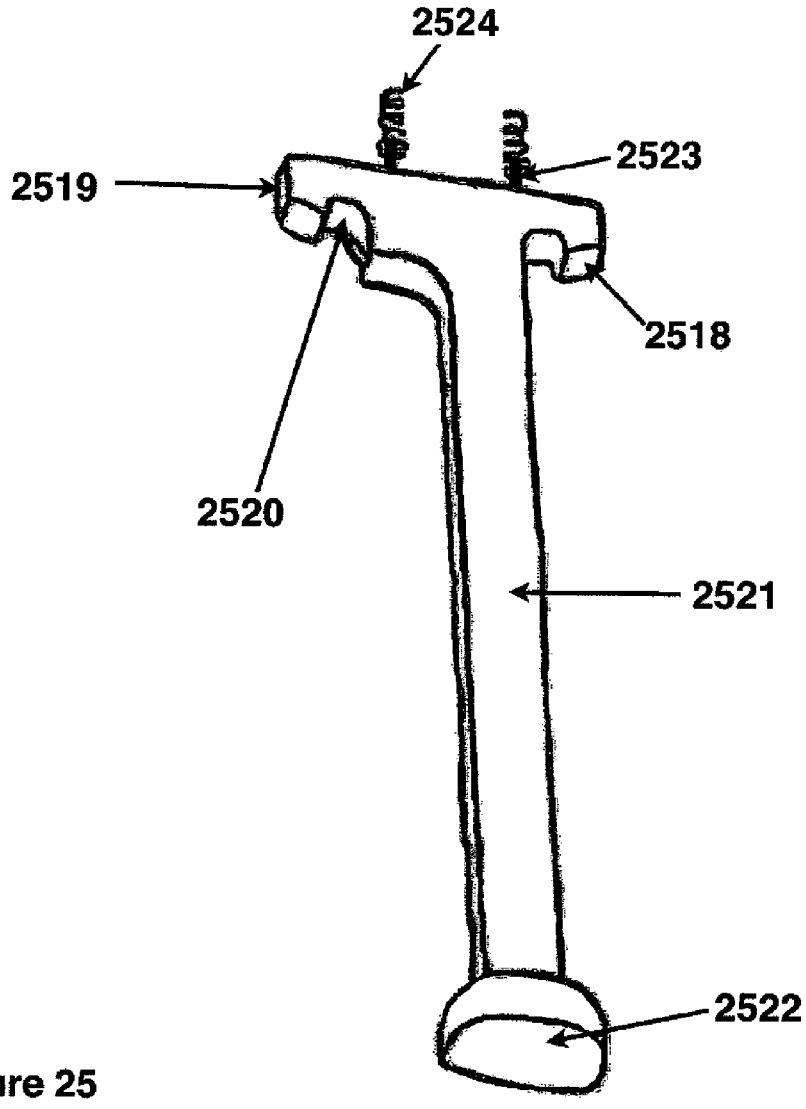
FIG. 25 is a top view of the release lever of the quick strap release mechanism.
Figure 26:
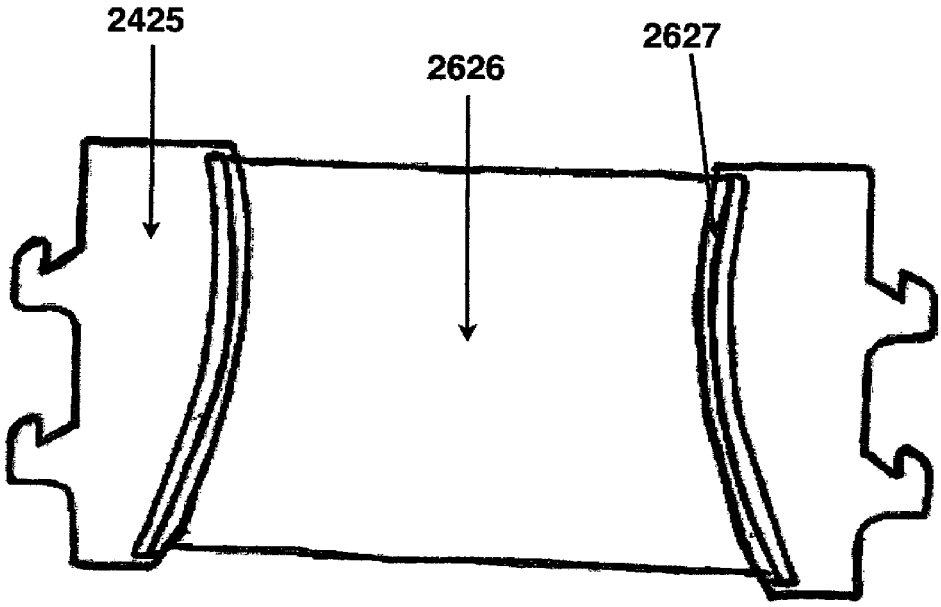
FIG. 26 is a posterior view of a removable strap. In one embodiment the strap can be one piece of material attached via the roll bar to both strap attachment mechanisms. In other embodiments the material may be multiple pieces attached to different sections of the roll bar and the material may be any suitable material for the purpose, such as leather, fabric, vinyl, but limited to these listed.

In some embodiments, the quick release mechanism shown in FIG. 25 can be one solid piece or several pieces. The quick release mechanism can be made of wood, plastic, pvc, abs, steel, or like-metal, and is not limited or to mentioned materials.

In some embodiments, the button is attached to the quick release lever. In some embodiments the button is a separate piece than the quick release lever. FIG. 25, shows one such quick strap release lever, with the button attached and one set of strap attachment hooks.

In another embodiment, the strap release lever could have multiple strap attachment hooks.

In the embodiment of FIG. 25, the strap release lever is placed in the empty cavity of the shoe base. The upper part of the release lever comprises of, but is not limited to: a spring attachment post 2523, a spring 2524, a female strap attachment hook 2519, and an empty cavity known as the female hook locking cavity 2520.

Figure 28:
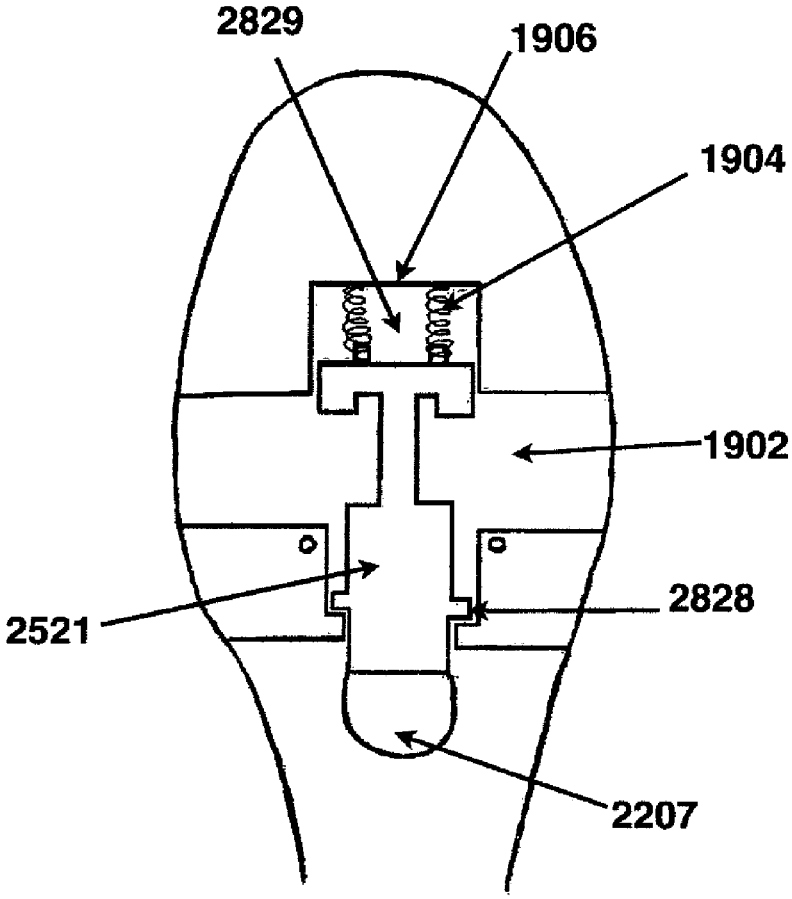
FIG. 28 is a posterior view of the strap attachment cavity with the strap release lever inserted into the cavity.

In other embodiments, there are multiple springs and spring attachment post, and several female attachment hooks and several female hook locking cavities. The strap release lever is placed in the empty shoe body cavity so that the top of the springs 2524 rests against the mating surface of the head of the base cavity 1906 shown in FIG. 19. When the springs 2524 are at rest, the spring is elongated and there is an empty space 2829 created in the strap attachment cavity. In FIG. 28, the button and the spring are at rest, creating the leverage space 2829 in the strap attachment cavity. When the button is pressed, the entire strap release lever moves forward, the spring shortens, and the top of the strap release lever moves closer to the mating surface 1906 of the shoe base. The female hook heads 2518 move forward as well and become flush with the sides of the strap attachment cavity. When the button is released, the strap release lever moves back to its original place, the string is returned to its natural state and the female hook heads return to their natural position. When the button is released, the stoppers at the end of the strap release lever, rest against the body of the shoe, thus ensuring that the button does not protrude past the body of the shoe base.

Figure 29:
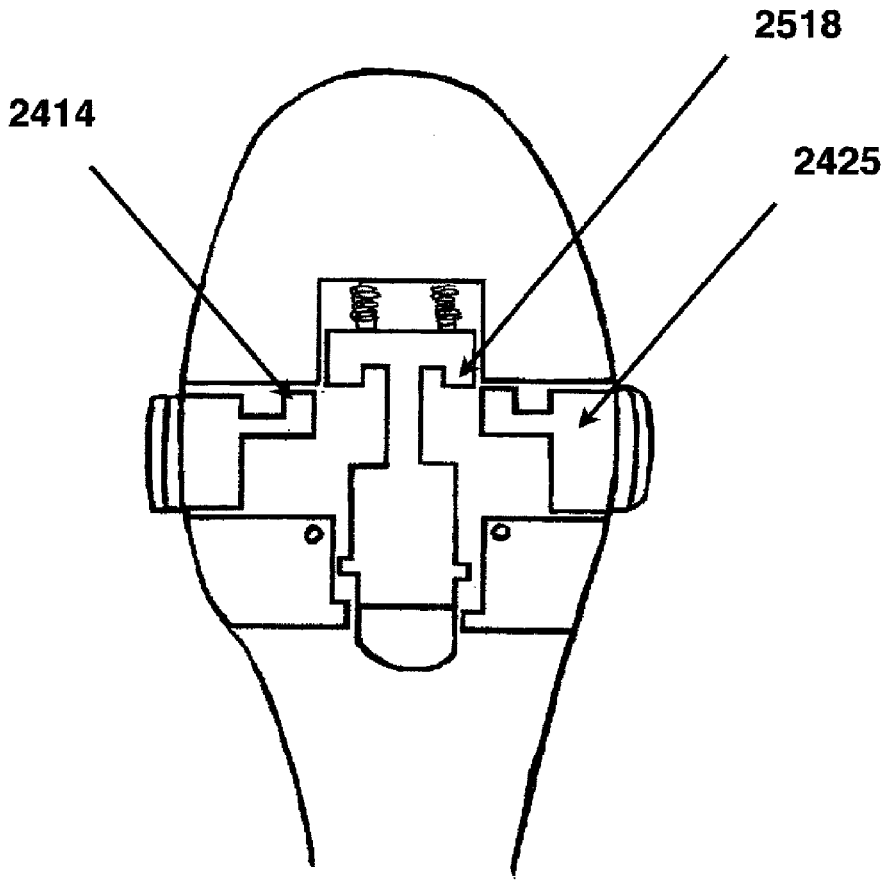
FIG. 29 is a posterior view of the strap attachment cavity with the strap release lever inserted into the cavity and the strap attachment pieces fitted into the strap attachment cavity.
Figure 30:
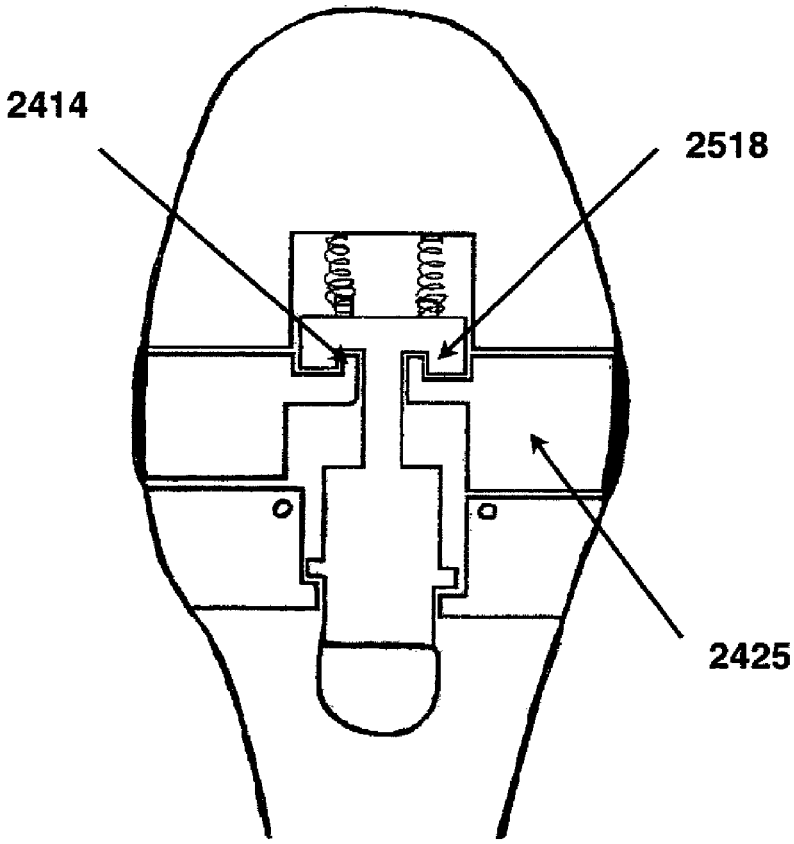
FIG. 30 is a posterior view of the strap attachment cavity showing the male and female hooks locked in place.

In FIG. 29, the illustration shows the strap attachment pieces 2425, being slid into the strap attachment cavity. When the base cover is attached to the base of the shoe, it exposes an open slot on the side of the shoe for the strap attachment pieces 2425 to enter the shoe. As the strap attachment pieces enter the shoe, the button is depressed by the user and held down. When the button is held down, the strap release lever is moved forward, the spring is shortened, thus causing tension. The male hook head 2414, moves forward into the cavity unobstructed. The male hook head moves forward until it rests against the side of the strap. The button is then released and the strap release lever moves back to its original rest position. The female hook head is lowered, thus trapping the male hook head inside the female hook locking cavity. This acts to secure the strap attachment device inside the shoe base until the button is re-pressed. The male and female hooks engage and block each other from leaving the shoe base. They create a barrier and the spring holds the tension on this barrier to keep the strap attachment pieces securely fastened.

In some embodiments, there are two or more male and female locking hooks attaching together, creating multiple areas of strap security.

In other embodiments, there is no button that needs to be depressed to allow the male hook head to pass the female hook head. In some embodiments the strap attachment piece is pushed into the strap cavity and a force is applied, causing the tension on the spring. The spring shortens in length, thus allowing the male hook head to pass the female hook head and locking the strap attachment mechanism inside the shoe base.

In some embodiments the spring is located in the button cavity 1903, instead of attached to the release lever. The spring attachment posts are attached to the back of the button cavity. In some embodiments the springs are attached to spring attachment post at the back of the button cavity and the tension used to move the strap release lever is applied by pressing the button. The springs touch the back of the button head and when the button is pressed the springs shorten in length, thus moving the strap release lever forward toward the mating surface 1906 on the shoe base, thus activating the quick release mechanism. The lever is moved forward toward the front of the shoe and the female hook heads are also moved forward allowing the male hook heads to slide into place. The button is then released and the male hook heads trap the female hook heads in place and secure the straps to the base.

Figure 24:
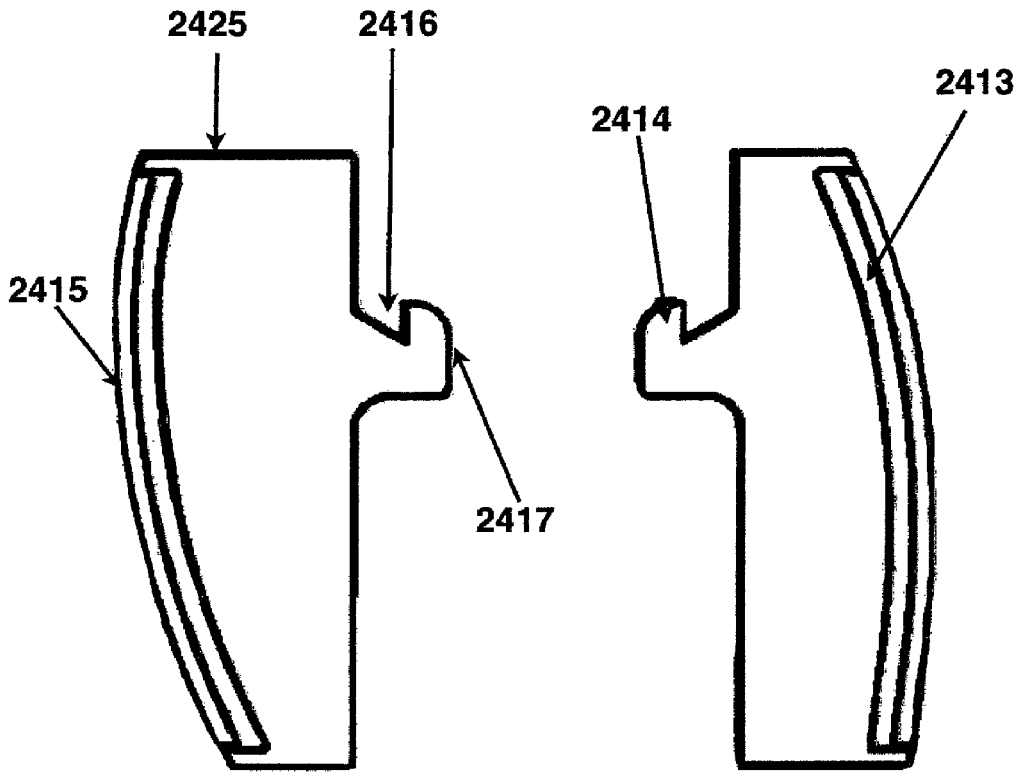
FIG. 24 is a posterior view of the strap attachment mechanisms. In one embodiment the strap attachment mechanism can have one hook locking device. In another embodiment, the strap attachment mechanism can have two hooks, in other embodiments there can be more hooks for locking.

In some embodiments, the strap attachment mechanism shown in FIG. 24 has one set of male hook heads or multiple male hook heads. The strap attachment mechanisms can be made of, but not limited to, plastic, abs, pvc, nylon, metal or wood. The strap attachment pieces have a roll bar 2415, and an open slot for material 2011, which can be one continuous slot or multiple slots for the strap material to slide through. Once the strap material is slid thru the material slots, the material is sewn to itself as shown in FIG. 27. In some embodiments the material is glued to itself or other material. In other embodiments the strap material comprises of several pieces of material fed thru the material slot and then attached to the itself.

In some embodiments the material used for the straps can be leather, fabric, vinyl, rubber, synthetic, satin, and/or other various materials. The strap material is not limited to the materials listed.

In some embodiments the button used to trigger the quick strap release mechanism is covered by the interchangeable wedge. The wedge needs to be removed first, and then the button can be exposed.

In some embodiments the button is not visible, it is recessed into the shoe. In other embodiments, the button is protruded on the outside of the shoe base.

In some embodiments the configuration of the quick strap release mechanism can vary. It includes, but is not limited to having a roll bar, that enters the shoe base completely or slightly protrudes the shoe base. In other embodiments, the roll bar is a solid piece of plastic of other suitable material with holes along the edges. The solid piece of plastic is fixed to the edge of the quick strap release mechanism and rests against the side of the shoe base once the mechanism is locked into place. The material is attached to the bar with rivets or other similar or suitable fixtures. The bar may be made of metal, pvc, plastic, wood, or other like material.

LIST OF NUMBERED PARTS FOR FIGS. 18 THROUGH 30 SHOWING SPECIFIC EMBODIMENTS

1801: Body of Shoe Base
1902: Strap attachment cavity
1903: Button Cavity
1904: Release Lever Cavity
1905: Screw Hole
1906: Mating surface for head of base cover
2207: Release Button
2208: Back end of Cover Plate
2309: Mating surface of Head of cover plate
2310: Side surface of cover plate
2011: Side surface of body of shoe base
2312: Base Cover
2413: Material Slot
2414: Male Hook Head
2415: Roll Bar
2416: Male Hook Locking Cavity
2417: Strap Attachment Hook—Male
2518: Female Hook Head
2519: Strap Attachment Hook—Female
2520: Female Hook Locking Cavity
2521: Release Lever
2522: Button
2523: Spring Attachment Post
2524: Spring
2425: Strap Attachment Quick Release Device
2626: Strap Material
2627: Sewing Seam—Used to Attach Material to Roll Bar
2828: Stoppers
2829: Leverage Space
2730: Shoe Sole It will become apparent to those skilled in the art that the disclosed embodiments of the invention are subject to a variety of medications without departing from the invention and such variations are assumed to be within the skill of those in the art such that they are included in this disclosure.

What is claimed is:

1. A collapsible shoe comprising:
- a base having a heel portion, wherein the heel portion comprises a base cavity;
- a heel insert configured to be accepted by the base cavity;
- a vertical lock disposed at the heel portion of the base, wherein the vertical lock engages the heel insert within the base cavity to secure the removable heel to the base;
- a horizontal lock disposed at the heel portion of the base adjacent to the vertical lock, wherein the horizontal lock engages the vertical lock in order to secure the vertical lock and to prevent the vertical lock from disengaging from the heel insert;
- a removable heel, wherein the removable heel includes a first cavity at a top portion of the removable heel and is configured to accept the heel insert, wherein the heel insert protrudes from the removable heel when secured to the removable heel so the heel insert can be inserted within the base cavity; and
- a removable heel blank that is interposed between the removable heel and the base when the removable heel is secured to the base.

2. The collapsible shoe of claim 1, wherein the heel insert is permanently secured to the removable heel with a bonding agent.

3. The collapsible shoe of claim 1 further comprising a removable ankle strap attachment piece that is interposed between the removable heel and the base when the removable heel is secured to the base.

4. The collapsible shoe of claim 1, wherein the removable heel further comprises a second cavity at a bottom portion of the heel and is configured to accept a reinforcement cylinder.

5. The collapsible shoe of claim 1 further comprising a base plate cover.

6. The collapsible shoe of claim 1 further comprising a removable strap device disposed within the base, wherein the removable strap device comprises a push button disposed against a base wall.

7. The collapsible shoe of claim 6, wherein the removable strap device may be pushed forward within the base in order to allow a removable strap to be engaged by teeth of the removable strap device on a left and right side of the base.

8. A method for securing removable components to a sole of a shoe, the method comprising:
- providing a cavity in the sole for accepting a removable heel;
- providing a first sliding lock within the sole for engaging the removable heel in order to secure the removable heel to the sole;

providing a second sliding lock within the sole for engaging the first sliding lock, wherein the second sliding lock prevents movement of the first sliding lock when the second sliding lock is engaged with the first sliding lock; and providing a removable ankle strap attachment piece that is interposed between the removable heel and the base when the removable heel is secured to the base.

9. The method of claim 8 further comprising providing a removable heel blank that is interposed between the removable heel and the sole when the removable heel is secured to the base.

10. The method of claim 8 further comprising providing a plurality removable heels having different shapes and different sizes configured to be accepted by the cavity in the sole.

11. The method of claim 8 further comprising providing a removable strap device within the sole of the shoe, wherein the removable strap device is configured to accept and secure at least one removable strap to the sole.

12. A collapsible shoe comprising:

a base having a heel portion, wherein the heel portion comprises a base cavity;

a heel insert configured to be accepted by the base cavity;

a vertical lock disposed at the heel portion of the base, wherein the vertical lock engages the heel insert within the base cavity to secure the removable heel to the base;

a horizontal lock disposed at the heel portion of the base adjacent to the vertical lock, wherein the horizontal lock engages the vertical lock in order to secure the vertical lock and to prevent the vertical lock from disengaging from the heel insert;

a wedge support slot disposed on the base; and a removable wedge having a rear support and a front support, wherein the removable wedge comprises (i) a first cavity at a top portion of the rear support configured to accept the heel insert, wherein the heel insert protrudes from the removable heel when secured to the removable wedge so the heel insert can be accepted by the base cavity, and (ii) a second cavity at a top portion of the front support configured to accept a wedge support insert, wherein the wedge support insert is configured to be secured to the wedge support slot of the base.

* * * * *